US008882642B2

(12) United States Patent
Chavez et al.

(10) Patent No.: US 8,882,642 B2
(45) Date of Patent: Nov. 11, 2014

(54) MEDICINE BALL DEVICE

(71) Applicants: Mark Chavez, Long Beach, CA (US); James Edward Grimes, Yorba Linda, CA (US)

(72) Inventors: Mark Chavez, Long Beach, CA (US); James Edward Grimes, Yorba Linda, CA (US)

( * ) Notice: Subject to any disclaimer, the term of this patent is extended or adjusted under 35 U.S.C. 154(b) by 198 days.

(21) Appl. No.: 13/632,831

(22) Filed: Oct. 1, 2012

(65) Prior Publication Data

US 2013/0085045 A1 Apr. 4, 2013

Related U.S. Application Data

(60) Provisional application No. 61/542,029, filed on Sep. 30, 2011.

(51) Int. Cl.

| | |
|---|---|
| ***A63B 21/04*** | (2006.01) |
| ***A63B 21/055*** | (2006.01) |
| ***A63B 21/06*** | (2006.01) |
| ***A63B 21/072*** | (2006.01) |
| ***A63B 21/00*** | (2006.01) |
| ***A63B 23/035*** | (2006.01) |

(52) U.S. Cl.

CPC ..... *A63B 21/0442* (2013.01); *A63B 21/0552* (2013.01); *A63B 21/0557* (2013.01); *A63B 21/0603* (2013.01); *A63B 21/072* (2013.01); *A63B 21/1426* (2013.01); *A63B 21/1438* (2013.01); *A63B 23/03541* (2013.01); *A63B 23/0355* (2013.01); *A63B 23/03575* (2013.01); *A63B 2209/10* (2013.01)

USPC ..... 482/93; 482/121; 482/139

(58) Field of Classification Search

CPC ..... A63B 21/06; A63B 21/002; A63B 21/02

USPC ..... 482/92, 93, 105, 89, 91, 110, 112, 121, 482/122, 124, 126, 148, 907

See application file for complete search history.

(56) References Cited

U.S. PATENT DOCUMENTS

| | | | | |
|---|---|---|---|---|
| 3,069,162 | A * | 12/1962 | Samuel | 482/110 |
| 3,269,727 | A | 8/1966 | Samuel | |
| 5,139,472 | A * | 8/1992 | Caruthers | 482/93 |
| 5,242,348 | A | 9/1993 | Bates | |
| 5,282,777 | A | 2/1994 | Myers | |

(Continued)

OTHER PUBLICATIONS

International Search Report and Written Opinion for PCT/US2012/058359, mailed Dec. 27, 2012, 9 pages.

(Continued)

*Primary Examiner* — Stephen Crow
*Assistant Examiner* — Gary D Urbiel Goldner
(74) *Attorney, Agent, or Firm* — Daniel R. Kimbell; Karish & Bjorgum, PC

(57) ABSTRACT

A medicine ball device having a shell portion with an internal cavity formed therein and an outside surface. A weight is located in the internal cavity. A pair of hand grips extends out of the shell portion at opposite sides thereof. A pair of elongate loop handles extend out of the shell portion from opposite sides of the shell portion, which elongate loop handles pass through the medicine ball device. The loop handles are formed as a strap that engages with the weight to prevent the elongate loop handles from being pulled out of the medicine ball device. A number of attachments accessible from outside of the shell portion are used to attach other devices to the medicine ball device.

12 Claims, 22 Drawing Sheets

(56) References Cited

U.S. PATENT DOCUMENTS

| | | | | |
|---|---|---|---|---|
| 5,399,136 | A * | 3/1995 | Bart | 482/110 |
| 5,735,776 | A * | 4/1998 | Swezey et al. | 482/91 |
| 6,068,580 | A * | 5/2000 | Myers et al. | 482/93 |
| 6,514,179 | B1 * | 2/2003 | Yu | 482/44 |
| 6,527,675 | B1 * | 3/2003 | Yu | 482/44 |
| 6,547,703 | B1 | 4/2003 | Swezey et al. | |
| 7,326,123 | B2 * | 2/2008 | Park | 473/256 |
| 7,686,740 | B1 * | 3/2010 | Chang | 482/50 |
| 2001/0001094 | A1 | 5/2001 | Panes | |
| 2003/0100408 | A1 * | 5/2003 | Chuang et al. | 482/44 |
| 2006/0264300 | A1 * | 11/2006 | Chen | 482/14 |
| 2011/0263393 | A1 * | 10/2011 | Ross et al. | 482/93 |
| 2012/0053024 | A1 * | 3/2012 | Mendoza | 482/106 |
| 2012/0157270 | A1 * | 6/2012 | Johnson | 482/93 |
| 2012/0184418 | A1 * | 7/2012 | Wilson | 482/112 |

OTHER PUBLICATIONS

International Preliminary Report on Patenability and Written Opinion for PCT/US2012/058359, mailed Apr. 10, 2014, 6 pages.

* cited by examiner

FIG. 9F
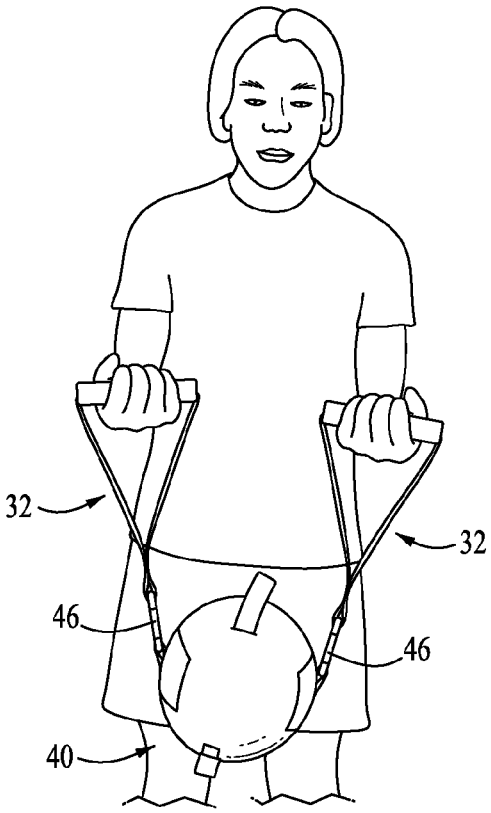
FIG. 9G
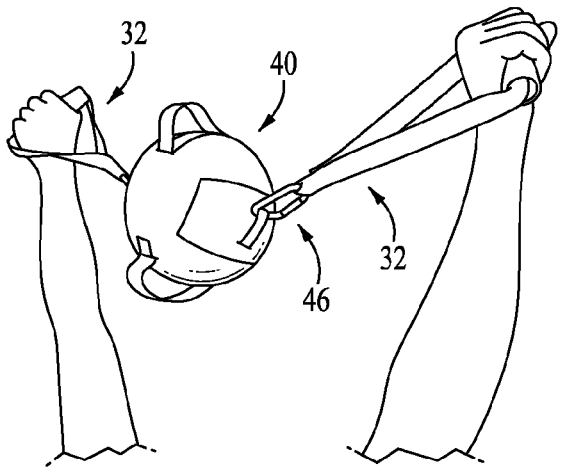
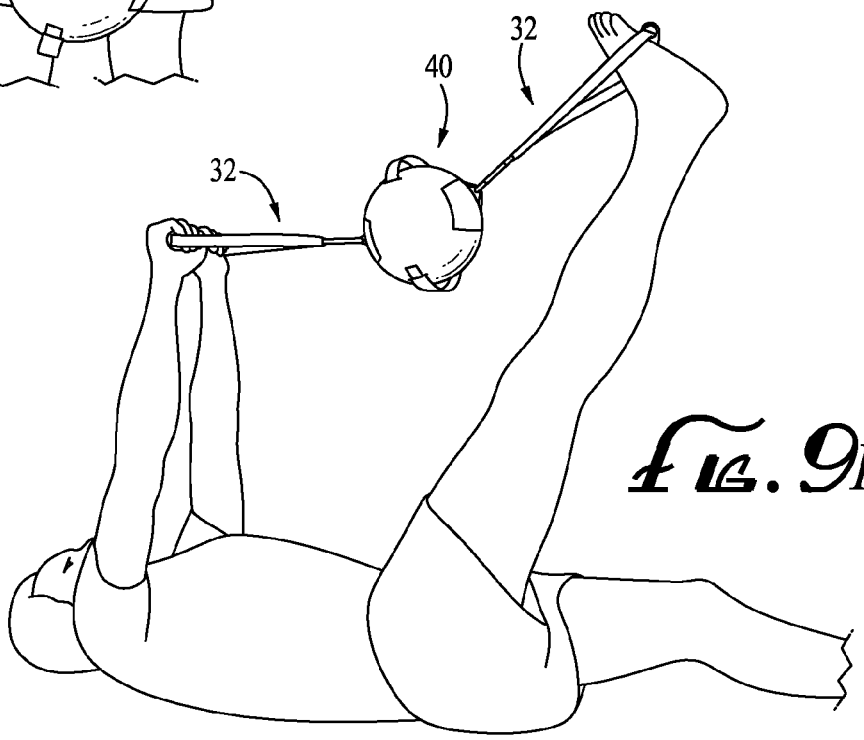
FIG. 9H

FIG. 22
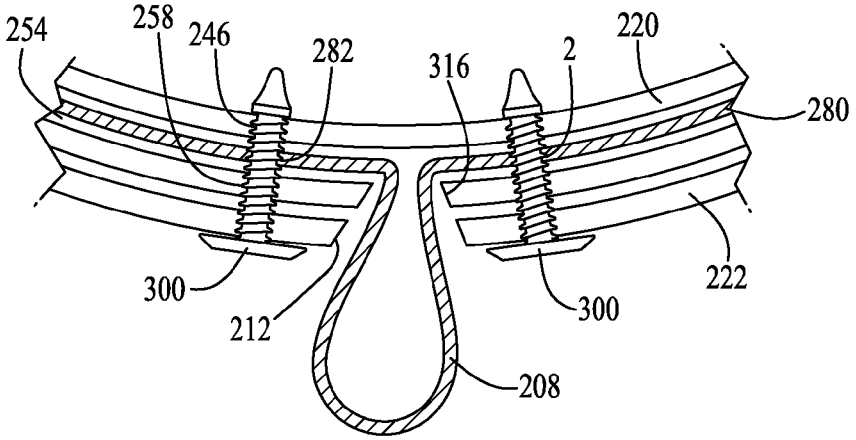
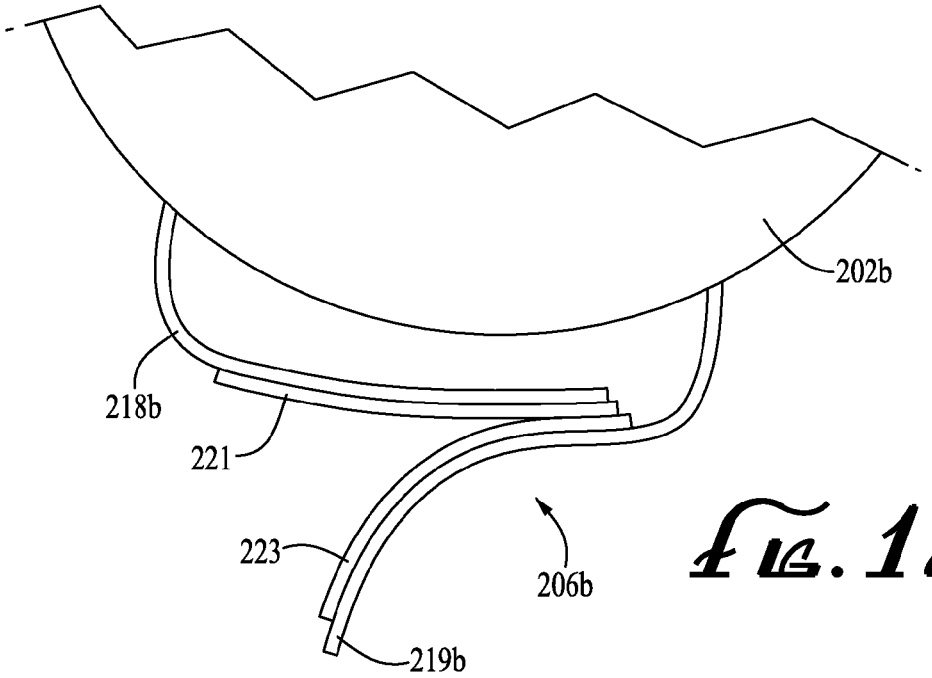
FIG. 12

MEDICINE BALL DEVICE

CROSS-REFERENCE TO RELATED APPLICATIONS

This application claims priority from U.S. Provisional Patent Application No. 61/542,029, filed Sep. 30, 2011.

BACKGROUND OF THE INVENTION

Medicine balls (also known as exercise balls or fitness balls) have, in one form or another, been used in the exercise, health and fitness fields since ancient times. Animal bladders filled with sand served as medicine balls in Persia over 3000 years ago. In Greece, in the time of Hippocrates, animal skins were sewn up and stuffed with sand to serve as medicine balls. Some of today's medicine balls are made with synthetic outer shell materials, which are then filled with sand, metal shot, other ballast materials, and often lighter filler material, such as yarn, foam, cotton, and the like, to provide a variety of medicine balls having a desired weight, hardness/softness, and size.

Many professional and student athletes, as well as the general public wishing to get into and stay in shape have found exercising with medicine balls to be helpful. Using medicine balls can help develop the abdominal and other core muscles by lifting and moving the medicine ball, for example while performing other exercises, such as doing leg lifts, sit ups, etc., in order to work certain muscles. Medicine balls are also used in rehabilitation of injured athletes.

Medicine balls currently made of various materials, such as leather, vinyl covered nylon, neoprene, polyurethane rubber, plastics, and the like, and are filled with sand, steel shot, and sometimes lighter weight stuffing. For balls that are intended to be bounced, they can be air filled.

Currently, there are medicine balls that incorporate two handles formed into opposite sides of the ball structure which are provided for gripping by users. Some other balls include a rope that passes through a middle of the ball. However, with these prior medicine balls, users are limited as to how they can exercise with the medicine balls. For example, the medicine ball itself is not well adapted to be used as an anchoring device for attachment of accessories, such as elastic straps, pulleys, accessory handles, wrist straps (that would allow hands free use), e.g., with clips and carabiners. Moreover, current medicine balls have not been useful for exercising the legs and other parts of the body due to their lack of engagements and use with other accessories.

SUMMARY OF THE INVENTION

The invention provides a medicine ball device with a plurality of attachment points that are adapted to be used to affix accessories, e.g., straps, elastic cords and bands, wrist and ankle straps, hand grips, and the like, to the medicine ball. For example, these attachment points can comprise loops of material, such as nylon straps, loops of material to which clips (e.g., metal or plastic rectangular rings, and D-rings, etc.) are permanently affixed, so that the attachment points are readily accessible by a user. These accessories are preferably attached with detachable clips, for example, such as carabiners, snap clips, and the like. It is also possible to simply loop the accessory through the attachment, such as the case with loops. In addition to the attachment points, the medicine ball device is provided with a pair of adjustable hand grips positioned on opposite sides of the medicine ball. These adjustable hand grips allow for quick and easy adjustment to comfortably fit a wide variety of user's hand sizes and preferences. In addition, a pair of elongate loop handles are likewise provided on opposite sides of the medicine ball, and are provided so that users can pass their hands and wrists, and/or feet therethrough for additional utility, as will be discussed below.

It is preferable that there be at least two attachment points which are located on opposite sides of the medicine ball device, and more preferable that there be at least three or four attachment points that are offset from each other. Even more preferably is that there are at least two sets of such opposing attachment points that are offset from each other by about 90 degrees. In the case of three imaginary orthogonal planes x, y, and z that pass through the medicine ball device, there will be pairs of attachments approximately located at intersections of where the planes pass through the outer surface of the medicine ball device. For a single pair of attachments, it might be, for example, at the intersections of the xy planes, for two pairs of attachments, it might be at the xy and yz planes, and for three pairs of attachments, at the xy, yz, and zy planes. An advantage of such an arrangement is that forces exerted on opposite ends of each pair of attachments will be offset through the center of the medicine ball. However, the attachments need not be offset from each other by 90 or 180 degrees and the attachments can be arranged on different positions on the medicine ball device, and it is possible to have more than six attachments on the medicine ball device if desired. Indeed, it is desirable to have to attachment points relative close to each other so that the medicine ball device itself can function as an anchoring device to which elastic cords, bands, and straps can be attached.

In the case of a medicine ball device with a molded rubber or plastic outer surface, the attachment points can also be molded with the outer surface of the medicine ball device so long as they are accessible and strong and resist tearing and detachable. In addition to the attachment points, one or more hand straps can be provided that will extend from an outer surface of the medicine ball device for gripping by a user. These hand straps may optionally include hold downs so that when not in use, the hand straps will lie relatively flat against an outer surface of the medicine ball device.

The attachment points and the hand grips are strongly secured to the medicine ball device such that even when great forces are exerted on the attachment points, the attachment points will not become detached from the medicine ball device, and will not unduly distort or damage the medicine ball device. If the material forming the outer shell of the medicine ball device is sufficiently strong, and the medicine ball device is filled with material that resists deformation, e.g., sand, metal shot, etc., then sewing or riveting the attachments to the outer shell of the medicine ball device may provide adequate strength. In addition and in lieu thereto, this can be accomplished by including in the medicine ball device an internal structure, such as internal straps, cables, a framework, that provides enhanced tensile strength so that as force is applied to attachment points, the attachment points will not become detached from the medicine ball device and the medicine ball will not become unduly distorted.

The medicine ball device can likewise be formed of a relatively stiff inner plastic shell (e.g., formed in two pieces that are attached together) to which is bound a softer rubber or plastic outer shell, and having a weight contained in the center of the plastic shell, and with the elongate grip straps and the adjustable hand grips passing into the interior and being retained in therein. In one embodiment, the straps can even pass around the weight contained in the center of the medicine ball.

BRIEF DESCRIPTION OF THE DRAWINGS

FIGS. 9A-9H are views showing an exemplary embodiment of the medicine ball device being used in various exercises of the upper body.

FIG. 12 is a detail view showing the hand grips of the medicine ball device.

FIG. 22 is a detail view showing another position of the stain loop.

DETAILED DESCRIPTION

Figure 1A:
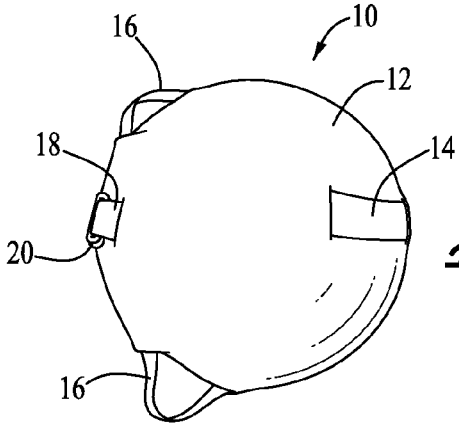
FIGS. 1A-1E are various views of a first embodiment of an exemplary medicine ball device 10 of the invention.
Figure 1B:
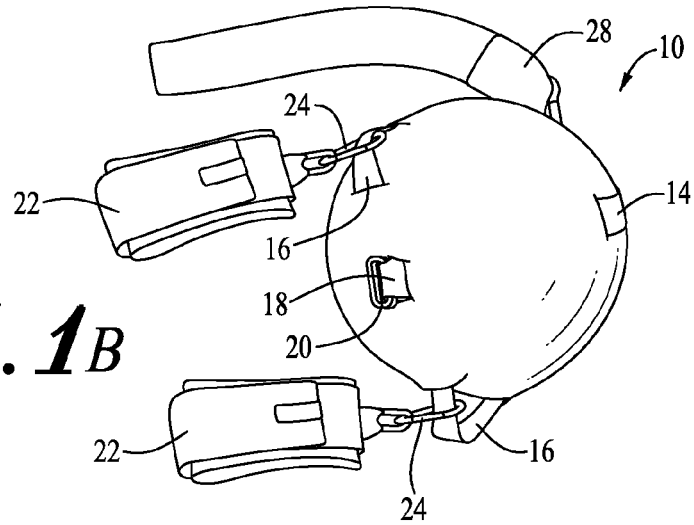
Figure 1C:
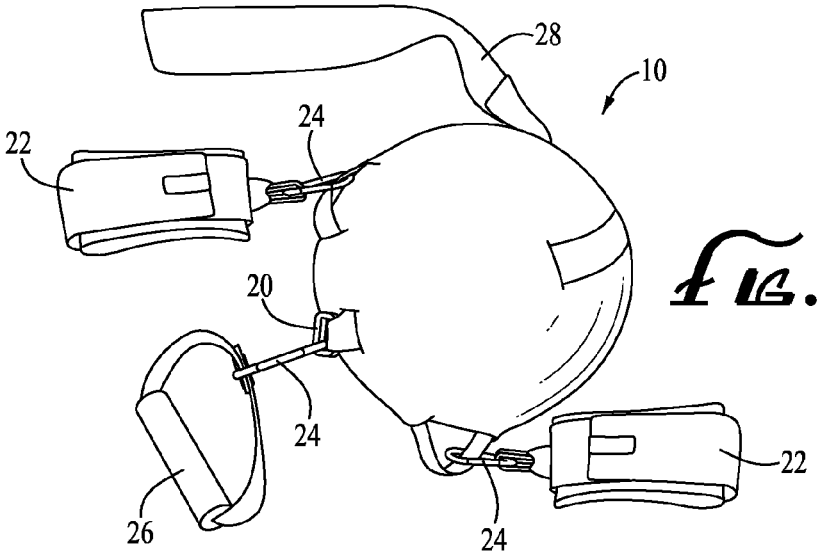
Figure 1D:
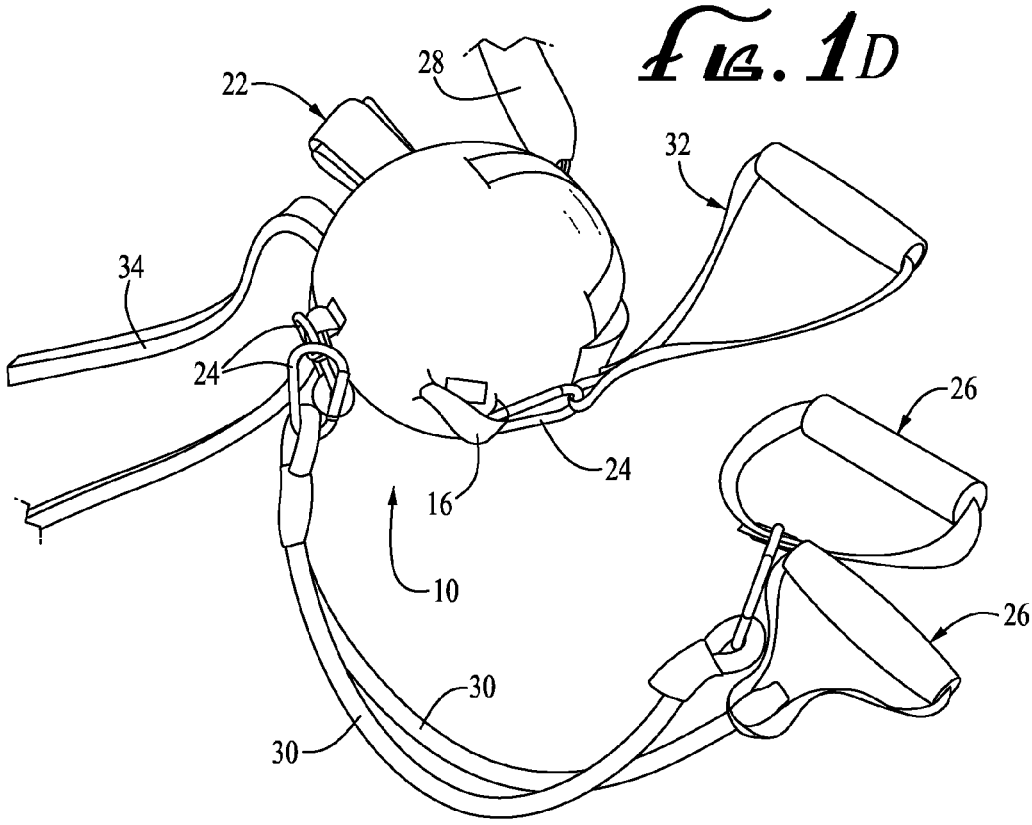
Figure 1E:
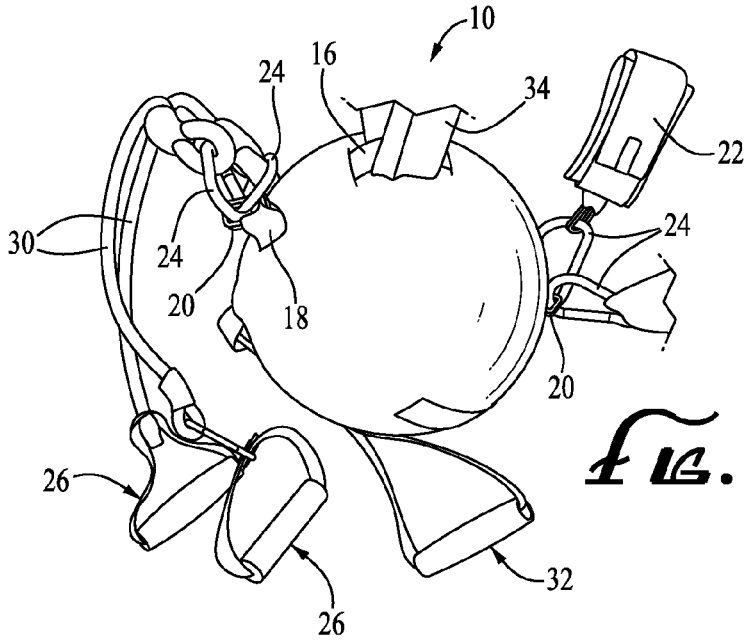

FIGS. 1A-1E show various views of a first exemplary embodiment of a medicine ball device of the invention 10. In FIG. 1A, the medicine ball device 10 is shown without any accessories attached. The medicine ball device 10 has an outer surface 12 and is generally spherical. A pair of opposing strap handles 14 extend from the outer surface 12. Additional attachments 16 (loops), and attachment 18 holding a pair of rectangular rings 20 are also positioned to extend from the outer surface 12. The medicine ball device 10 can be formed of material such as reinforced nylon fabric, plastic coated fabric, leather, plastic, rubber, and the like. Turning to FIGS. 1B-1F, various accessories are shown connected to the attachments on the medicine ball device 10. For example, in FIGS. 1B-1F, wrist bands 22 are shown attached to the loops 16 with carabiner clips 24. An elongate strap 28 is attached to another attachment point (not shown). In FIG. 1C, a hand grip 26 is attached to the rectangular rings 20 via a carabiner clip 24. FIG. 1D shows additional elastic cords 30 with hand grips 26 attached to the rectangular rings 20, with carabiner clips 24, and hand grips with elongate straps 32 attached to the loops 16 with carabiner clips 24. FIG. 1E shows how multiple accessories can be attached to a single attachment, and shows an elastic band 34 is looped through loop 16.

Figure 2:
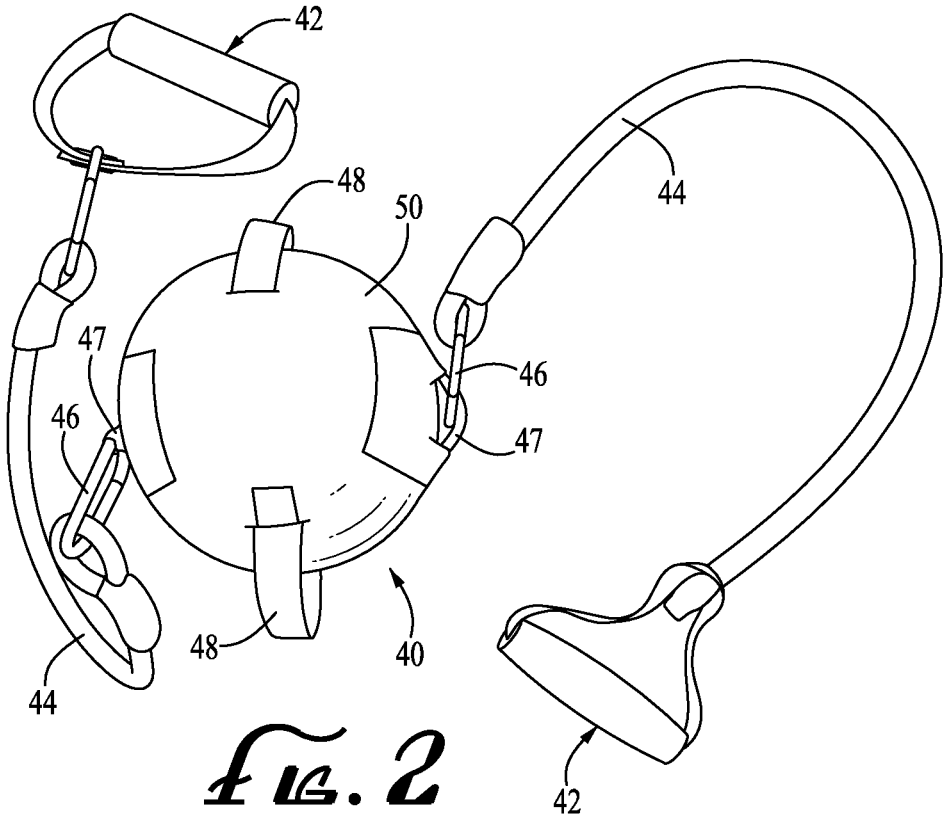
FIG. 2 is a second embodiment of the medicine ball device of the invention, with exemplary accessories attached.

FIG. 2 is a second embodiment of the medicine ball device 40 of the invention, with accessories attached. For example, handles 42 with attached elastic cords 44 are attached to loops 47 of the medicine ball device 40 with carabiners 46. The medicine ball device 40 also includes handle straps 48 affixed to an outer surface 50 of the medicine ball device 40.

Figure 3:
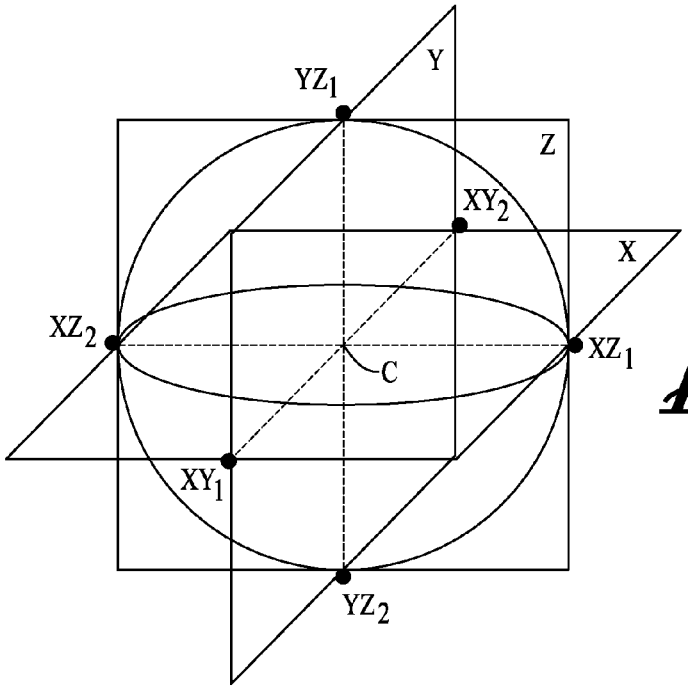
FIG. 3 is a diagrammatic view showing orthogonal planes passing through a sphere representing a medicine ball device with attachment points of the invention.

FIG. 3 is a diagrammatic view showing orthogonal planes x, y, and z passing through the center C of a sphere S representing a medicine ball device, showing three pairs of representative attachment points $xy_1$, $xy_2$, $yz_1$, $yz_2$, and $xz_1$, $xz_2$ of the invention. In fact, odd number of attachment points can be provided, and the attachments need not be offset 90 degrees or 180 agrees apart from each other. The actual points of attachment of the attachments will not be points, but will be vicinities on the medicine ball device.

Figure 4:
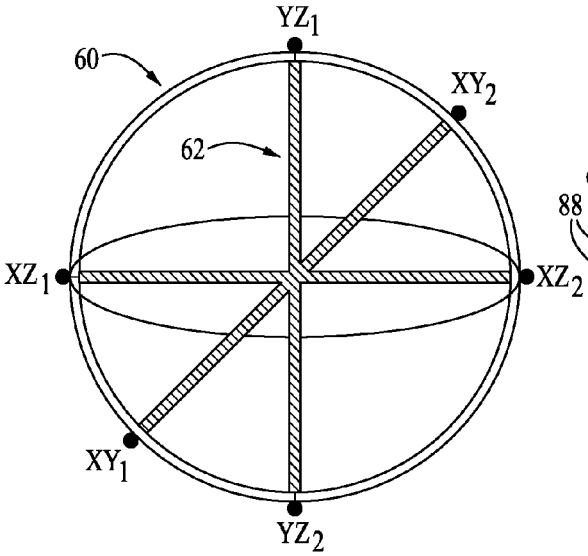
FIG. 4 is a diagrammatic view showing an exemplary embodiment of an internal structure of a medicine ball device with attachment points.

FIG. 4 is a diagrammatic view showing an exemplary embodiment of an internal structural support 62 of a medicine ball device 60 showing the exemplary attachment points $xy_1$, $xy_2$, $yz_1$, $yz_2$, and $xz_1$, $xz_2$. The internal structural support 62 can comprise a plurality of straps for internally tensioning the medicine ball device 60 with the ends of the straps being in the vicinity of the attachment points $xy_1$, $xy_2$, $yz_1$, $yz_2$, and $xz_1$, $xz_2$. In lieu of straps, cables, rods, and/or fibers, a plastic or metal structure and the like can be used to enhance the strength of the medicine ball device 60.

Figure 5:
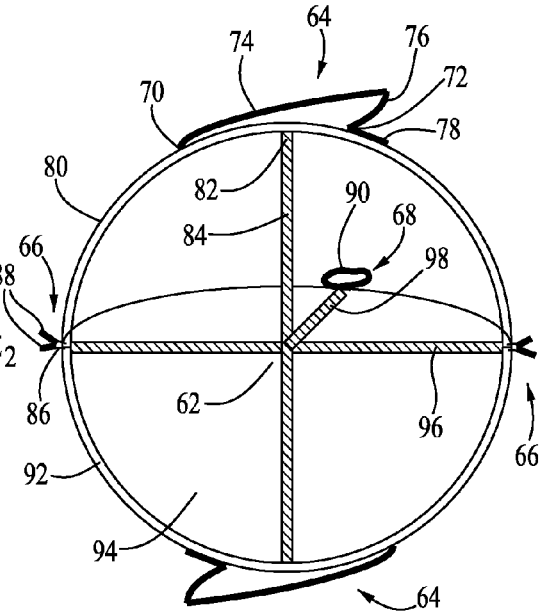
FIG. 5 is a diagrammatic cross-sectional view showing an exemplary embodiment of an internal structure of a medicine ball device with exemplary attachments.

FIG. 5 is a diagrammatic cross-sectional view showing an exemplary embodiment of an internal structural support 62 of a medicine ball device 60 with exemplary attachments 64, 66, and 68. For example, the exemplary attachments 64 can comprise a loop strap of fabric (e.g., nylon) which is long and wide enough for a person's hand to slide therein. Ends 70 and 72 are fixed to the medicine ball device 60. The loop strap 64 will have an upper portion 74 and a connected pivot portion 76. The pivot portion 76 has hook and loop material on its outer face and complementary hook and loop material 78 is provided below on the medicine ball device so that the loop strap 64 can be retained relatively flat against the outer surface of the medicine ball device 60 when not in use. In the case of the loop strap attachments 64, they may be attached to an outer surface 80 of the medicine ball device 60 in the vicinity of an end 82 of a strap 84 of the internal support structure 62. The exemplary attachments 66 comprise a loop 86 of material that retains two metal or plastic rectangular rings 88. Accessories can be engaged with the rings 88 directly, or with detachable clips. The exemplary attachments 68 comprises a loop of fabric 90 fixed to the outer surface 80 of the medicine ball device 60 near the ends of the internal support structure straps 98. Accessories can be clipped and otherwise detachably attached to the loop of fabric 90. Other types of attachments can also be provided on the medicine ball device 60, and at different positions on the medicine ball device 60. The hand grips can be made to be adjustable in length (not shown). The medicine ball can be made of a shell 92 of strong material, such as coated nylon fabric, other coated fabrics, leather, rubber, plastic, and the like. The attachments can be sewn, glued, riveted, or otherwise attached to the outer shell 92. In cases where the outer shell is formed by molding, the attachments can be molded together with the rest of the medicine ball device. However, in such cases where the attachments are molded together with the rest of the medicine ball, for added strength and tear resistance, it is preferable that the attachments be reinforced so that they do not pull free from the medicine ball device. The interior space 94 of the medicine ball device will be filled with dense material, such as sand, metal shot, and the like (not shown). For control of the total weight of the medicine ball device (e.g., so that they can be provided in a variety of weights, such as 5 lb, 10 lbs, 15 lbs), in addition to varying the size of the medicine ball device, it is also possible to include lighter filling material, such as yarn, foam material, wood chips, and the like. It is also possible to include a padding layer in the medicine ball device so that the outer surface of the medicine ball device is relatively soft and pliable so that if a user hits the medicine ball device, it will not hurt. The internal support structure straps 84, 96 and 98 can have their ends fixed to the walls of the medicine ball device.

Figure 6A:
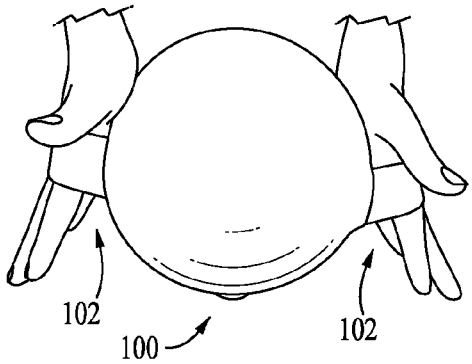
FIGS. 6A-6D are views showing an exemplary embodiment of the medicine ball device of the invention being held by a user by its integral hand straps.
Figure 6B:
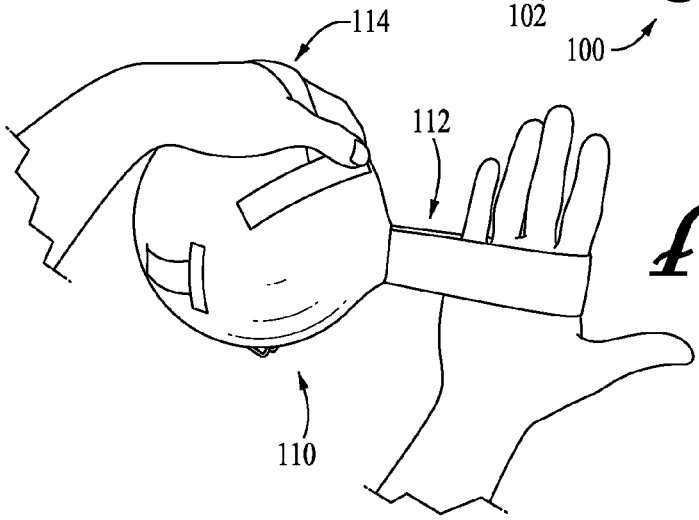
Figure 6C:
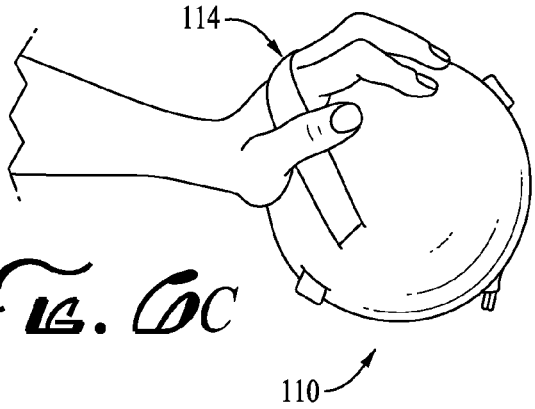
Figure 6D:
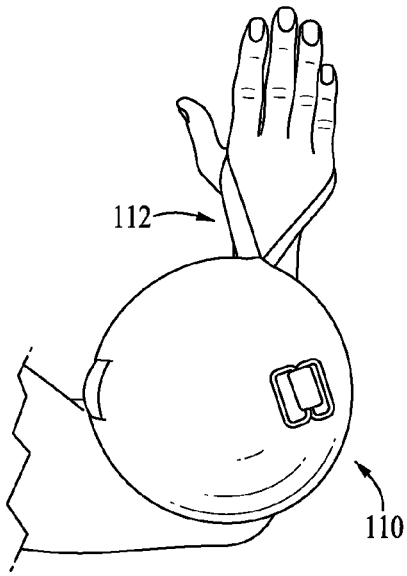

FIG. 6A is a front view showing an exemplary medicine ball device 100 of the invention, being held by a user's hands that are engaged with two integral loop straps 102. FIG. 6B is a view showing another exemplary medicine ball device 110 of the invention with one of a user's hands looped through an elongate strap 114 and with the user's other hand being engaged with an integral loop strap 114. FIG. 6C is a view showing a user palming the exemplary medicine ball device 110, and FIG. 6D is a view showing a user holding the exemplary medicine ball device 110 by the elongate strap 112 doing over arm lifts.

Figure 7A:
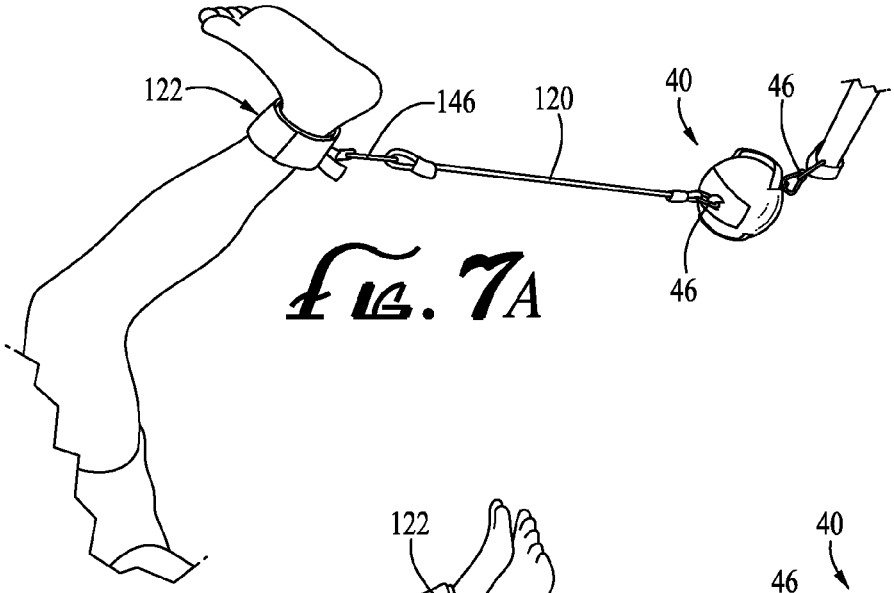
FIGS. 7A-7D are views showing an exemplary embodiment of the medicine ball device being used for leg exercises, with the medicine ball device serving as an anchoring device.
Figure 7B:
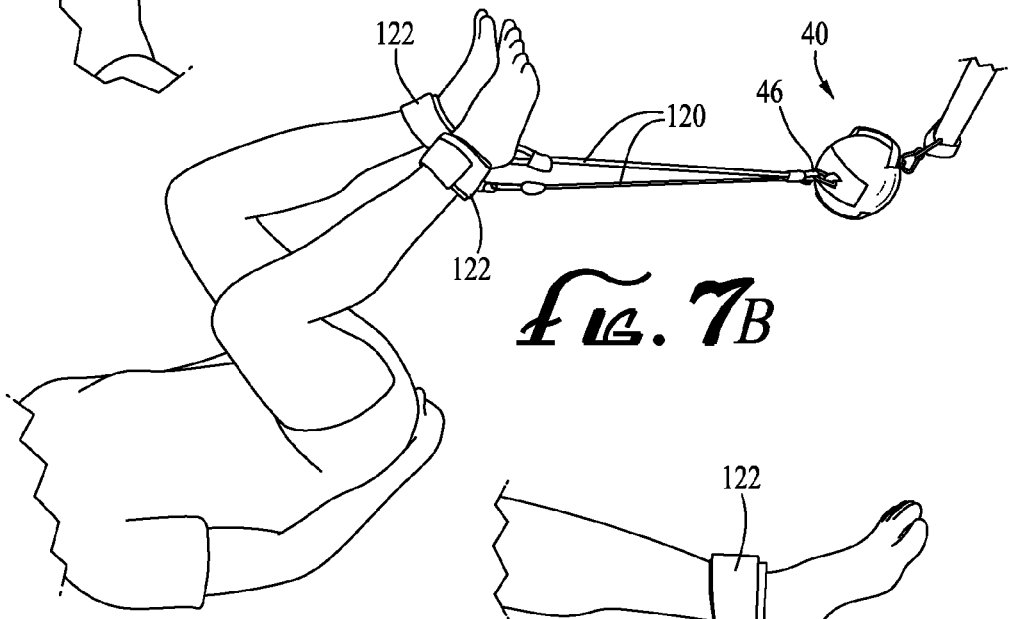
Figure 7C:
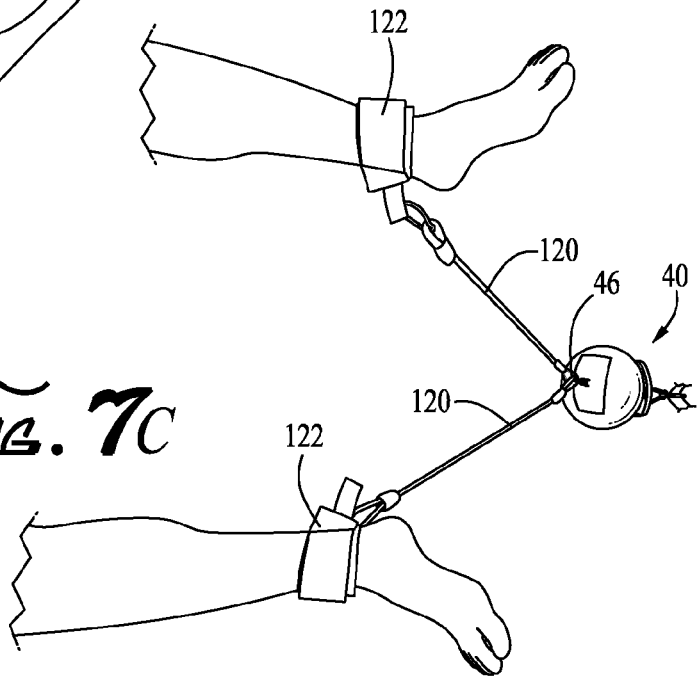
Figure 7D:
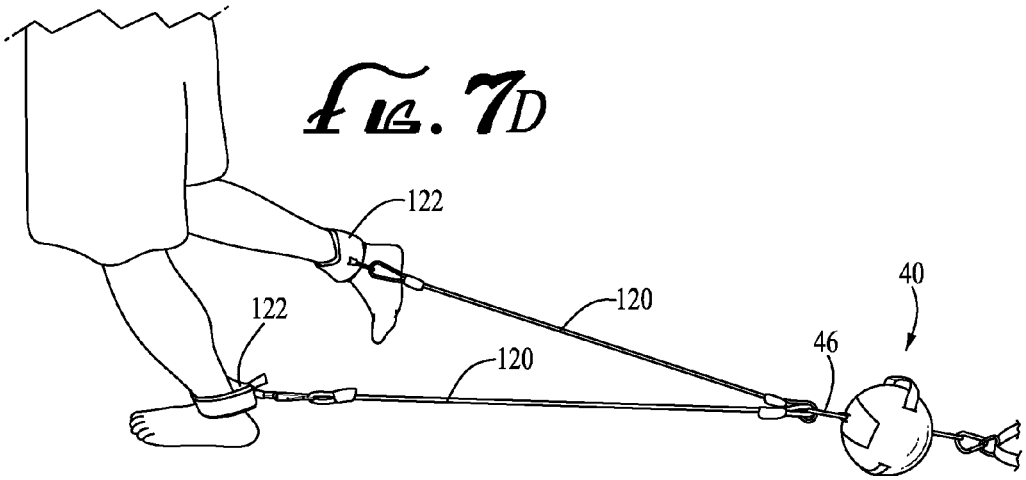

FIGS. 7A-7D are views showing the medicine ball device 40 of FIG. 2 being used for leg exercises, with the medicine ball device 40 serving as an anchoring device to another object (a couch.) In FIG. 7A, a single elastic cord 120 connects between the medicine ball device 40 with a clip 46 and an ankle strap 122 with another clip 46. In FIGS. 7B-7D, the user wears ankle straps 122, which are connected with separate elastic cords 120 to the medicine ball device 40 with a clip 46.

Figure 8A:
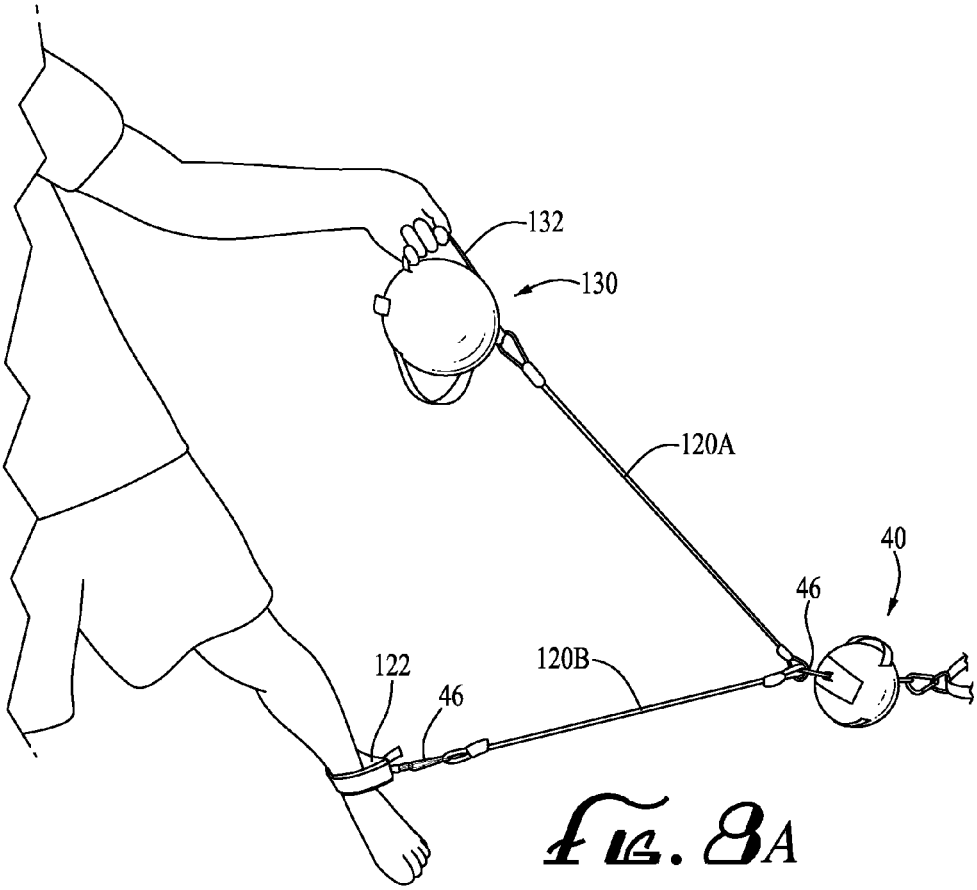
FIGS. 8A-8B are views showing two exemplary medicine ball devices being used during exercise.
Figure 8B:
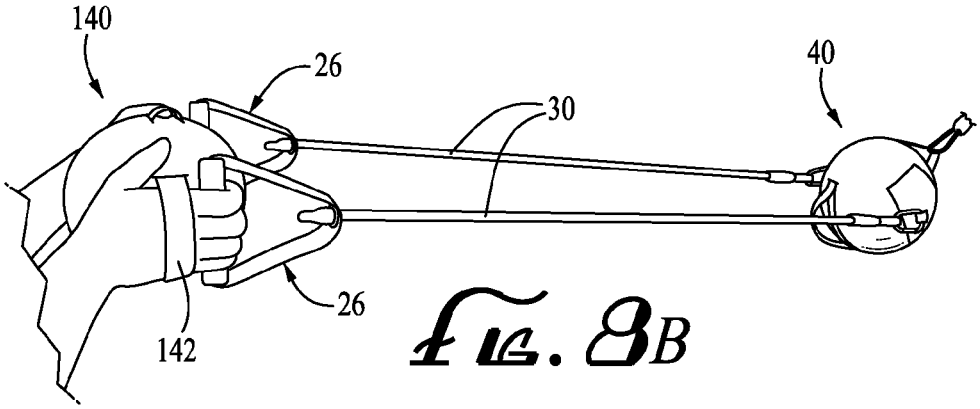

FIG. 8A is a view showing two exemplary medicine ball devices 40 and 130, and 40 and 140 being used during exercise. In FIG. 8A, the user is shown holding an exemplary medicine ball device 130 by a hand strap 132, which in turn is attached via an elastic band 120A to the medicine ball device 40 which serves as an anchoring device to a couch. Another elastic band 120B is connected between a clip 46 and the medicine ball device 40 and an ankle strap 122 with a clip 46. In this exercise, the user not only gets the benefit of the tension of the elastic band 120A on his upper body, but also the benefit of having to hold the medicine ball device 130, while also being able to work the user's legs and core. In FIG. 8B, the user holds another medicine ball device 140 by its hand straps 142 and also hold hand grips 26 which are connected by to elastic cords 30 to the medicine ball device 30.

Figure 9A:
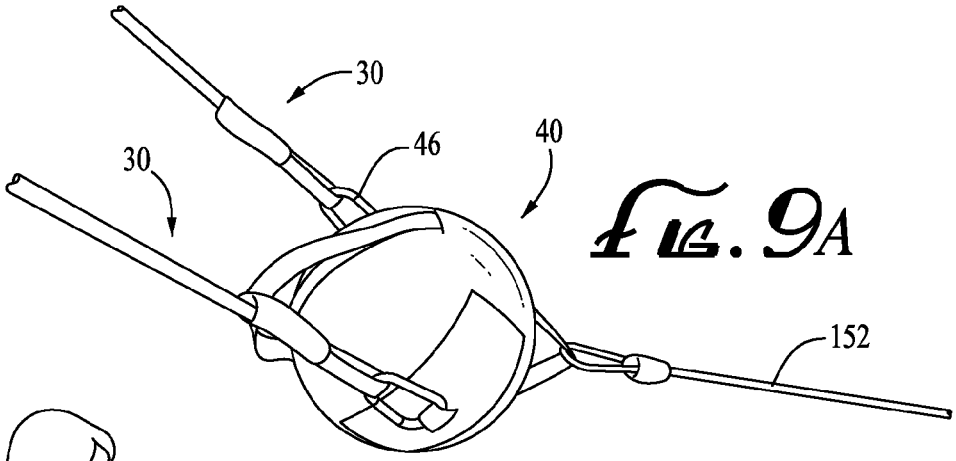
Figure 9B:
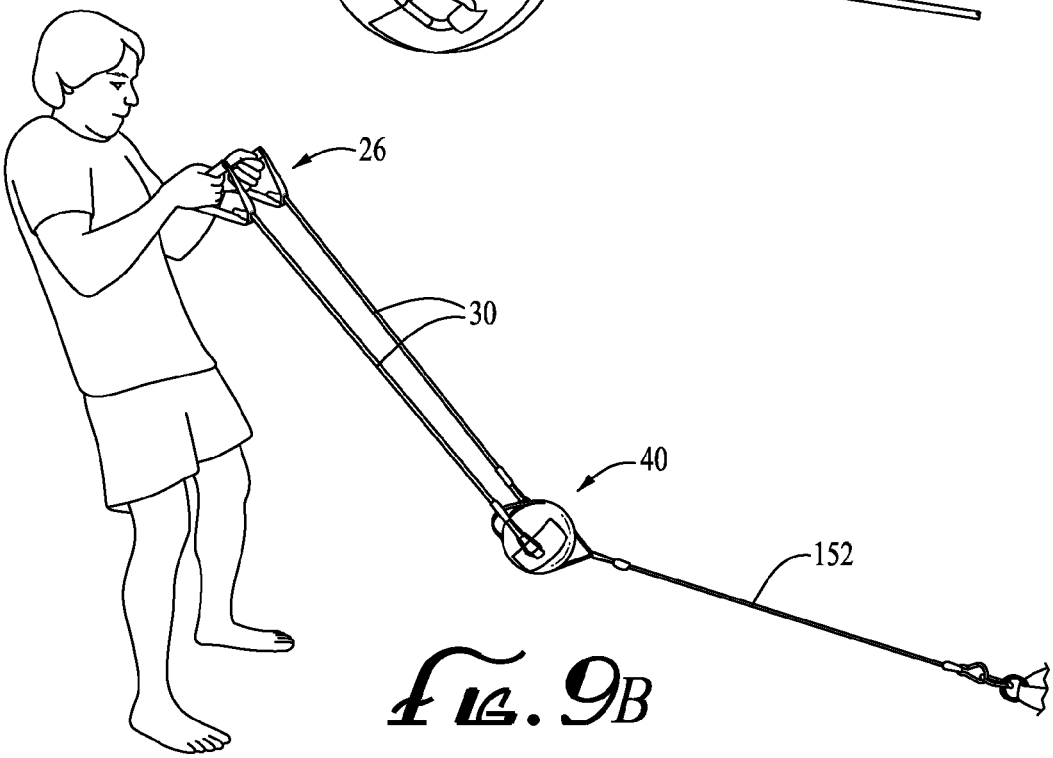
Figure 9C:
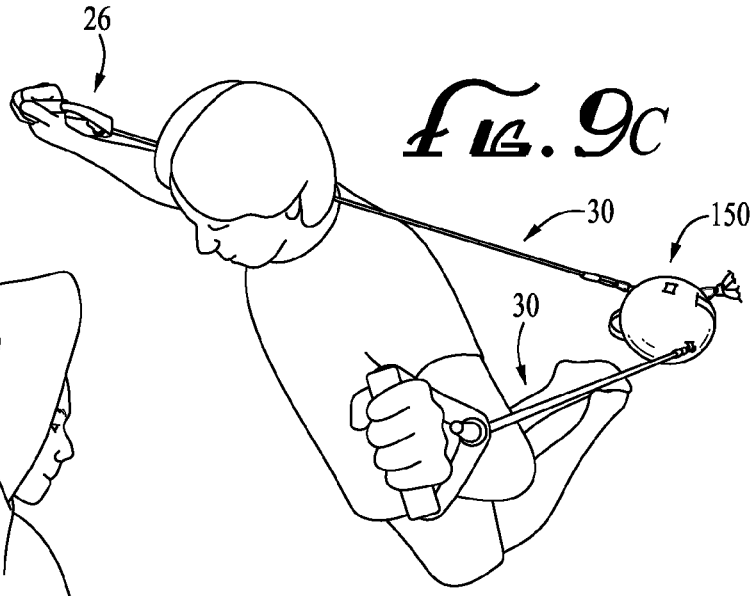
Figure 9D:
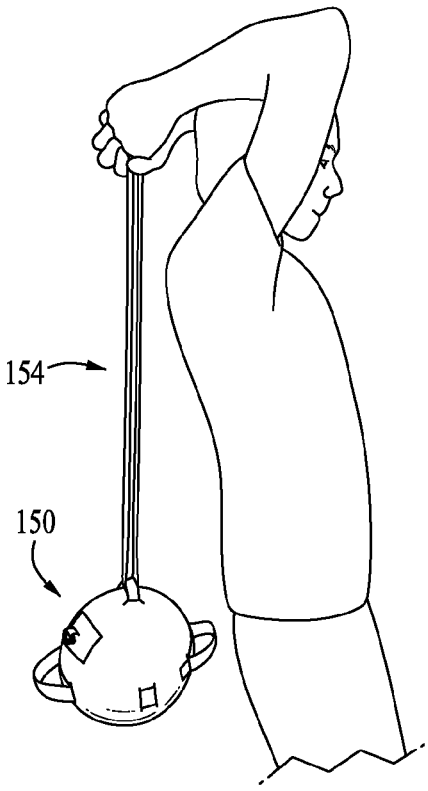
Figure 9E:
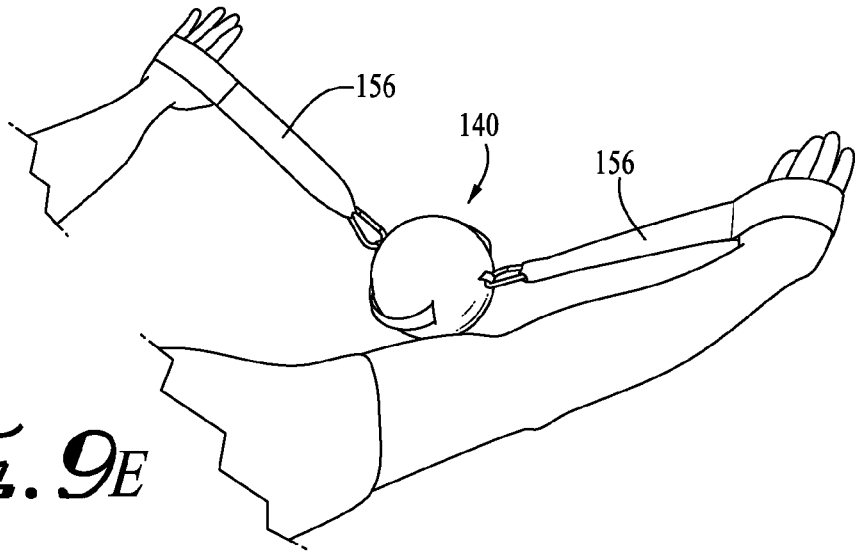

FIGS. 9A-9H are views showing an exemplary embodiment of medicine ball devices 40 and 150 being used in various exercises of the upper body, with elastic cords 30 and hand grips 26 connects to medicine ball device 40, which is likewise retained by another elastic cord 152 (FIGS. 9A and 9B) to a stationary object (a couch.) FIG. 9D shows an exemplary embodiment of a medicine ball device 150 being suspended by an elastic strap 154 and used to work on a user's triceps. In FIG. 9E a user's arms and shoulders are being worked out by using two elongate loop straps 156 attached to opposite attachments on the medicine ball device 140. FIGS. 9F and 9G show a medicine ball device 40 attached with clips 46 to two attached hand grips with elongate straps 32 being used for arm, shoulder and back exercises. The hand grips with elongate straps 32 uniquely allow a user to turn and twist his or her wrist during exercise to mimic natural joint pivot, which is difficult to accomplish with other exercise devices, for example, barbells and other weights, and will permit a user to exercise in a completely efficient manner and without causing wrist strain. Moreover, since the weight of single medicine ball device 40 is carried by two of the hand grips with elongate straps 32, users can choose how much force each arm will expend handling the medicine ball device. Furthermore, by attaching the hand grips with elongate straps 32 to different attachments on the medicine ball device 40, the user can vary how far apart the hand grips will be. FIG. 9H is a view showing the same setup of FIGS. 9F and 9G used between a user's hands and legs.

Figure 10:
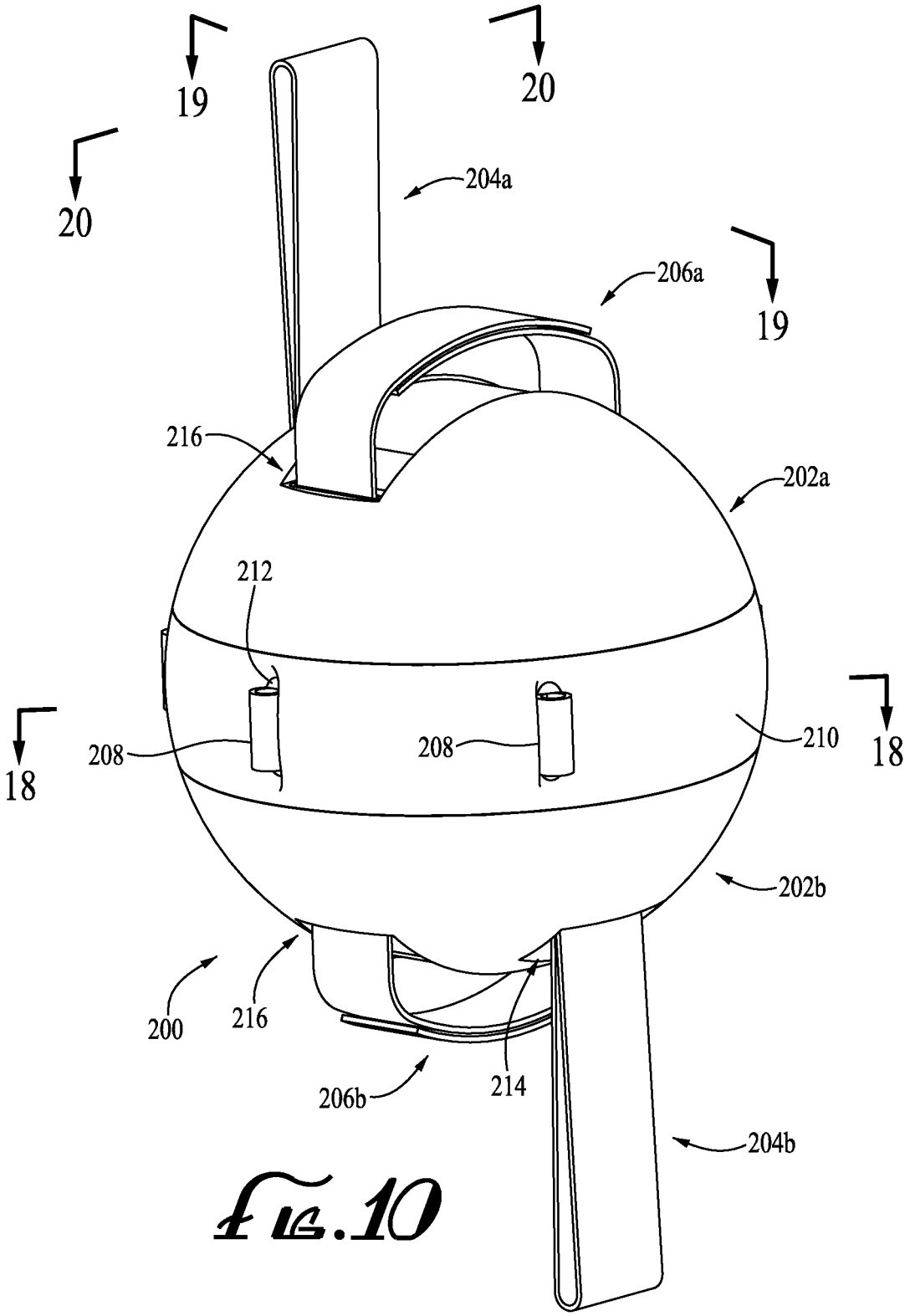
FIG. 10 is a perspective view of another exemplary embodiment of a medicine ball device of the invention.
Figure 11:
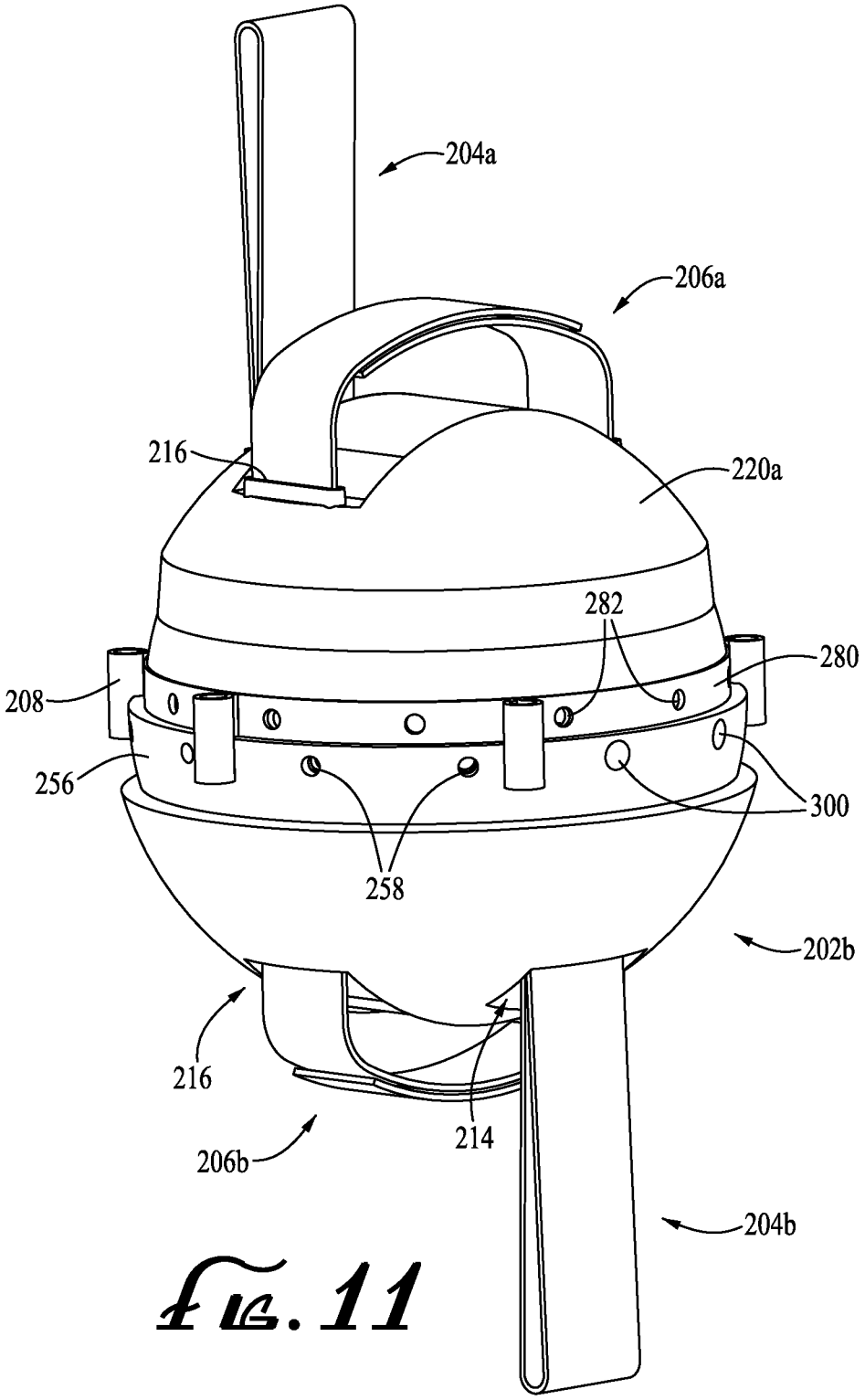
FIG. 11 is a similar to FIG. 10 but with a center band and the outer shell removed from the top half of the medicine ball device.
Figure 13:
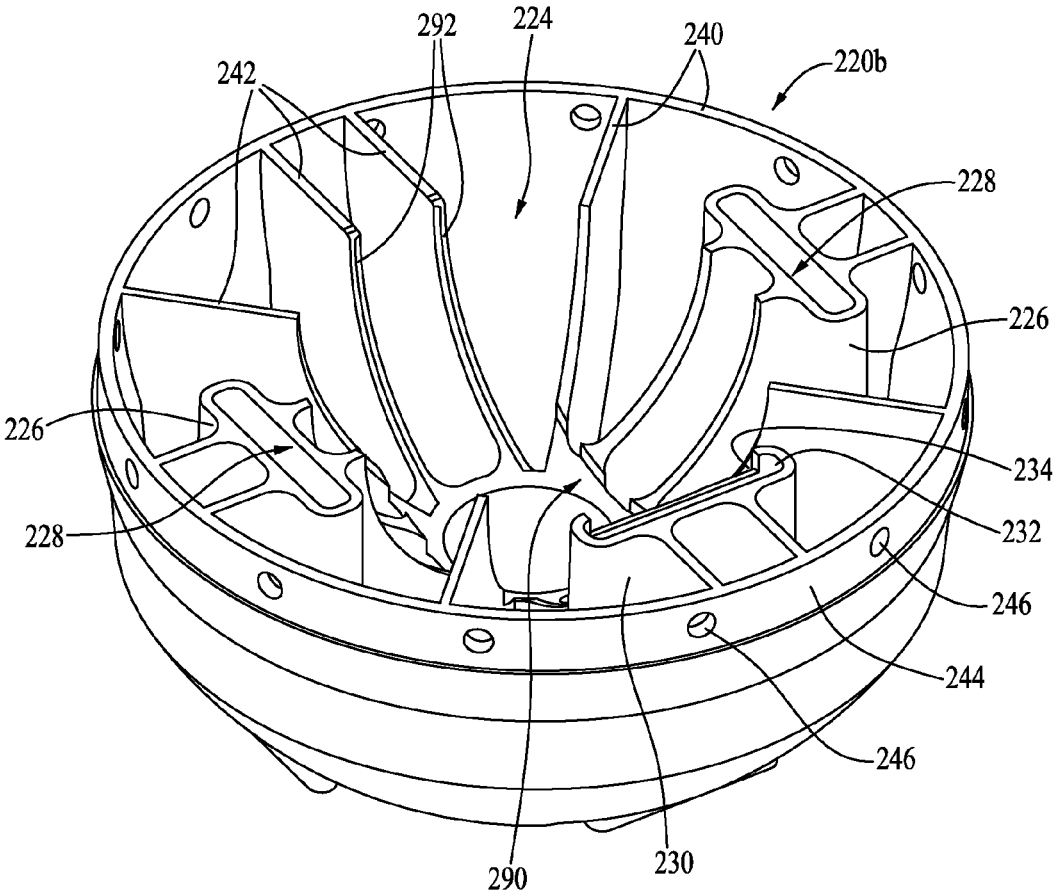
FIG. 13 is a top perspective view of an inner shell portion of the medicine ball device.
Figure 19:
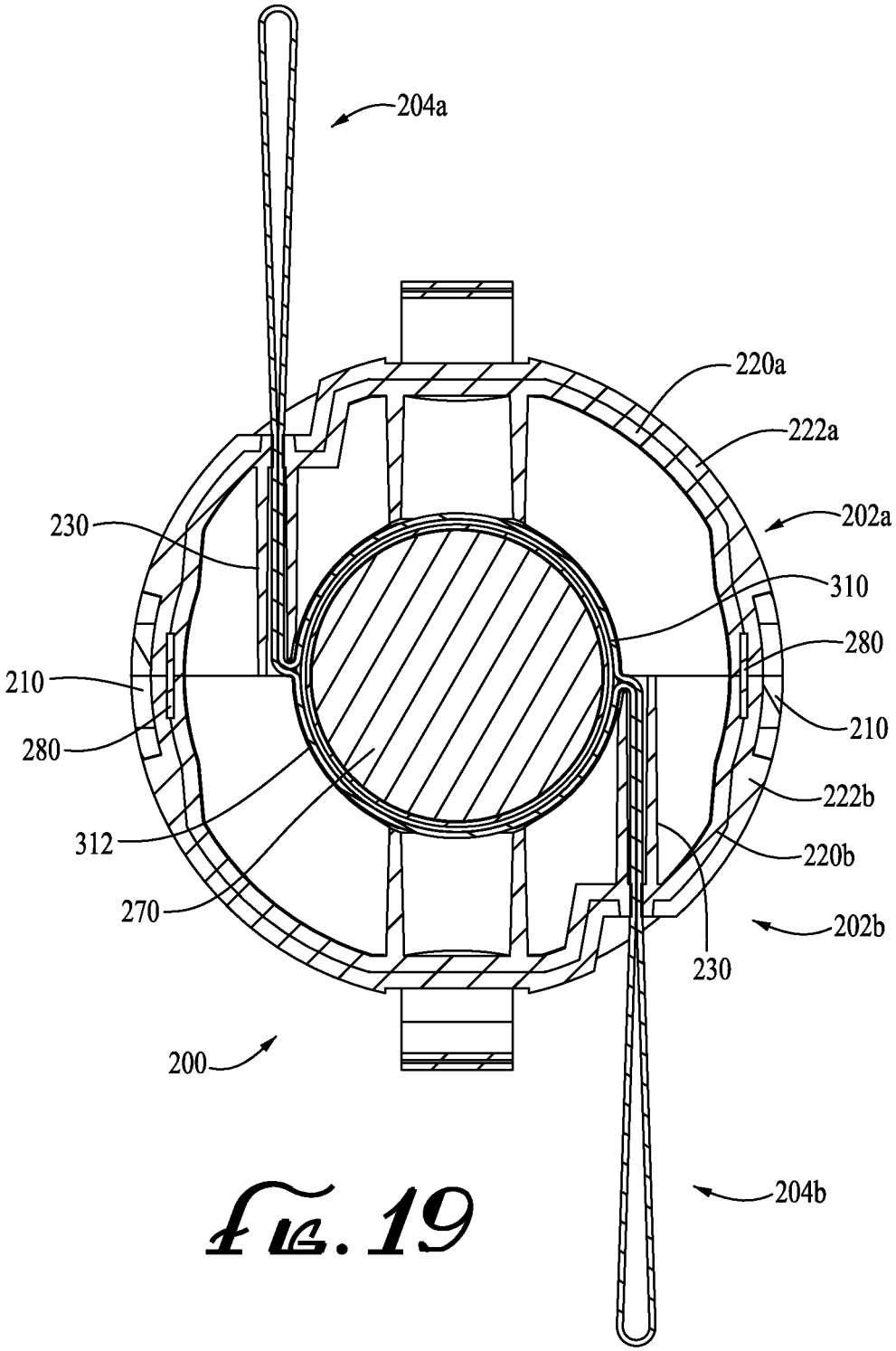
FIG. 19 is a cross-section view along view lines 19-19 of FIG. 10.
Figure 20:
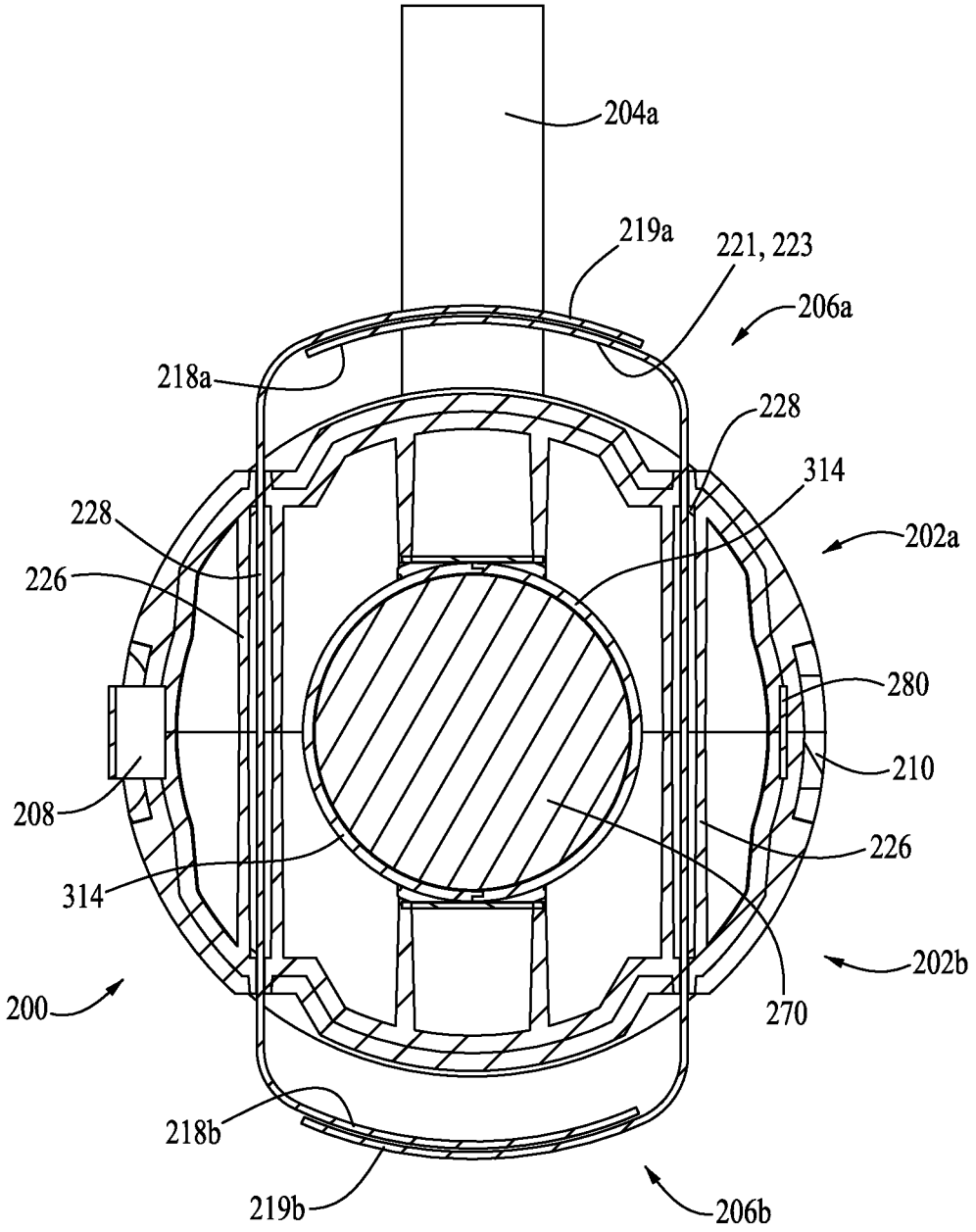
FIG. 20 is a cross-section view along view lines 20-20 of FIG. 10.
Figure 21:
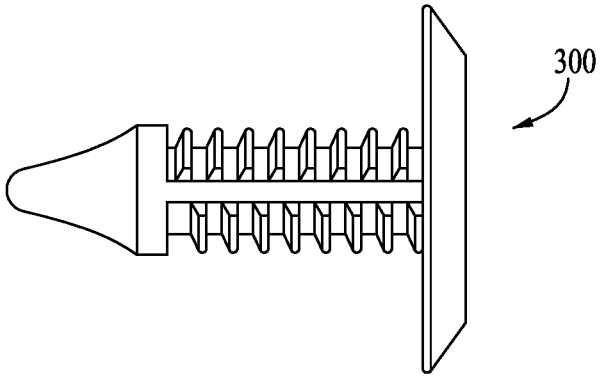
FIG. 21 is a side view of an exemplary fastener that may be used in the assembly of the medicine ball device of the invention.

Turning next to FIGS. 10-21, there are shown various views of another embodiment of a construction of an exemplary medicine ball device 200. Referring first to FIG. 10, there is shown perspective view of the completely assembled medicine ball device 200, and FIG. 11 is a similar view but with a center band 210 and outer shell portion 222*a* removed from the inner shell portion 220*a* of the upper half shell portion 202*a* to better reveal its construction. The medicine ball device 200 has two half shell portions 202*a* and 202*b*, a pair of elongate loop handles 204*a* and 204*b*, and a pair of hand grips 206*a* and 206*b*. The elongate loop handles 204*a* and 204*b* and the hand grips 206*a* and 206*b* are preferably formed of flexible strap material. Attachments, in the form of loops 208 of a strain loop 280 are shown, as is a center band 210 which covers a perimeter rim 256 in the vicinity of where the two half shell portions 202*a* and 202*b* are joined. The strain loop 280 has a plurality of holes 282. The loops 208 pass through loop apertures 212 in the center band 210. The elongate loop handles 204*a* and 204*b* pass through loop handle apertures 214 formed in the half shell portions 202*a* and 202*b*, and the sections of straps making up the hand grips 206*a* and 206*b* pass through hand grip apertures 216 formed in the half shell portions 202*a* and 202*b*. Extending around the centerline of the medicine ball device where the two half shell portions 202*a* and 202*b* are joined together is a perimeter rim 256 that is adapted to receive the center band 210. As shown in FIG. 13, holes 246 are formed in the inner shell portion 220, which holes 246 are aligned with holes 258 in the outer shell portion 222. The strain loop 280 with plurality of holes 282 formed therein is used to permanently engage the two half shell portions 202*a* and 202*b* together, such as with inserted fasteners 300 that pass through the holes 258 formed on the outer shell portion 222, the holes 282 in the strain loop 280, and finally through the holes 246 in the inner shell portions 220. The fasteners can be in the form of compression fasteners that once install will not back out. FIG. 21 is a side view of an exemplary fastener 300 that may be used in the assembly. Additionally, rivets, screws, and the like can be used. Adhesives can likewise be included to help hold the various pieces together. The center band 210 covers up the fasteners 300, and can be adhered in place if desired. The center band 210 is preferably formed of stretchable material, such as rubber, vulcanized rubber, plastic, and the like.

As best shown in FIG. 12, which is a detail view, the hand grips 206*a* and 206*b* can comprise two sections of flexible strap material 218*a* and 219*a*, and 218*b* and 219*b*, respectively. Each flexible section of strap material 218*a* and 219*a*, and 218*b* and 219*b* can include detachable attachment material 221 and 223, such as hook and loop material, hook and hook material, or the like, attached to facing surfaces of the sections of flexible strap material 218*a* and 219*a*, and 218*b* and 219*b*, to allow a working length of the hand grips 206*a* and 206*b* to be adjusted by a user as needed. In lieu of detachable attachable material, other known mechanical adjustment mechanism, such as buckles, snaps, etc., can be used. Although each hand grip 206*a* and 206*b* is shown as having two strap sections, in another embodiment, detachable attachment material can instead only be provided at one of the two hand grips 206*a* or 206*b*, with the other hand grip 206*b* or 206*a* comprising a continuous loop, and with user being able to slid the straps through the medicine ball device to adjust the working length of the hand grip without the detachable attachment material, and with the other hand grip being adjusted by adjusting the degree of overlap of the two strap portions.

Turning to FIG. 13, there is shown a top perspective view of an inner shell portion 220*b*. The other inner shell portion 222*b* (not shown) is identical. Being able to use identical inner shell portions means that the same molds can be used to form both of the half shell portions 202*a* and 202*b*. The same is true for an outer shell portion 222*a* (not shown). Hereinafter, when we refer to one of the half shell portions 202*a* or 202*b*, the description equally refers to the other half shell portion 202*b* or 202*a*. The inner shell portion 220*b* has a weight cavity 224 positioned therein and is preferably adapted to receive half of a generally spherical shaped weight 270 (see FIGS. 14, 15, 17-20.) Located in the inner shell portions are two hand grip standups 226 that have hand grip apertures 228 formed therethrough. These apertures 228 are sized and shaped to permit the straps making up the hand grips 206*a* and 206*b* to pass straight therethrough, which are shown in other views. Also located in the inner shell portion 202*b* is an elongate loop handle standup 230 that has a loop handle aperture 232 formed therethrough. At an innermost edge of the loop handle standup 230 there is a cutout 234 which allows sections of the strap making up the loop handles 204*a* and 204*b* to bend thereover without impinging above a level of the flat end face 240 of the inner shell portion 220*b*. Ribbing 242 can be molded together with other portions of the inner shell portion 220*b* to provide the desired degree of stiffness and resilience to the finished medicine ball. When the two half shell portions 202*a* and 202*b* are brought together, the flat end faces 240 of each will impinge against the other. As noted above, the weight cavity 224 is preferably adapted to receive a spherical weight 270, such as in the form of a ball, as shown in FIGS. 14, 15, and 17-21. A cutout path 290 is formed in the weight cavity 224 and is adapted to receive a section of the loop strap forming the elongate loop handles 204*a* and 204*b*, and is preferably sized to have a width to accommodate the width of the strap thereof as it rides adjacent to the weight ball 270. The strap will also ride against inner edges 292 of the ribbing 242, so that close proximity is maintained between the weight ball 270 and the inside of the weight cavity 224. Formed around a circumferential rim 244 of the inner shell 220*b* are a series of holes 246.

Figure 14:
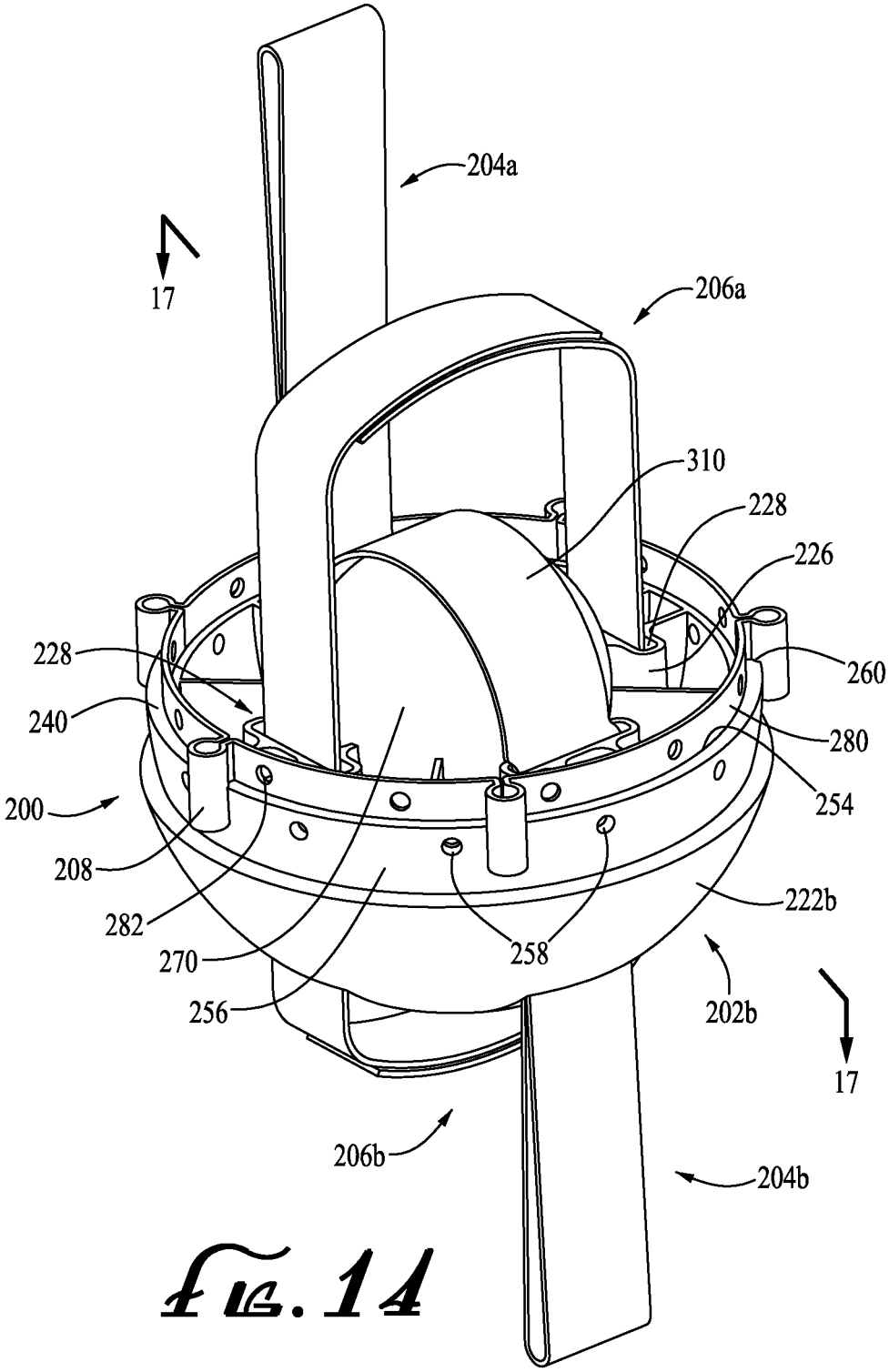
FIG. 14 is a top perspective view of the medicine ball device of FIG. 10 but with a top half shell portion removed.
Figure 15:
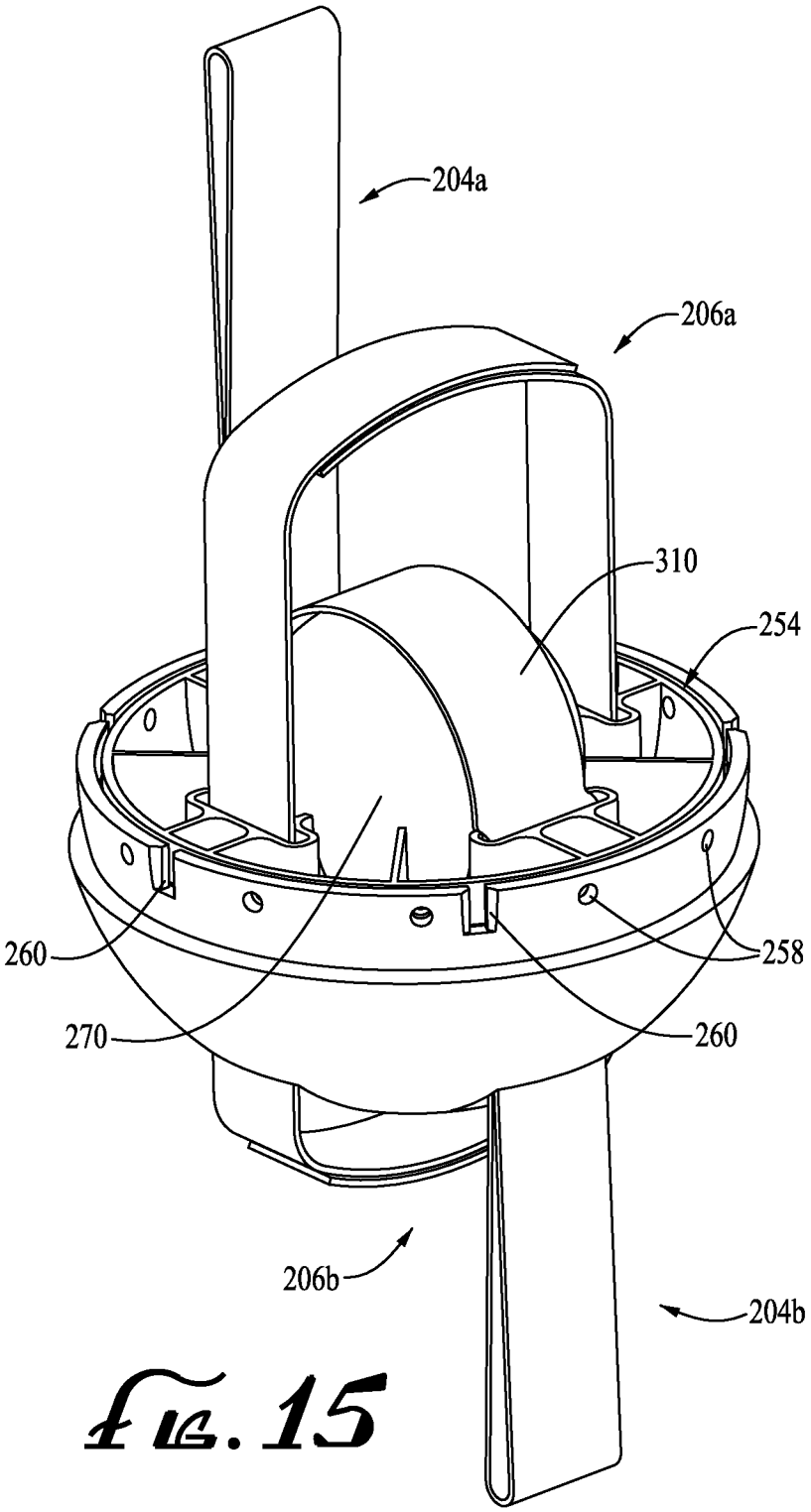
FIG. 15 is a view similar to that of FIG. 14, but with the center tension band removed.
Figure 16:
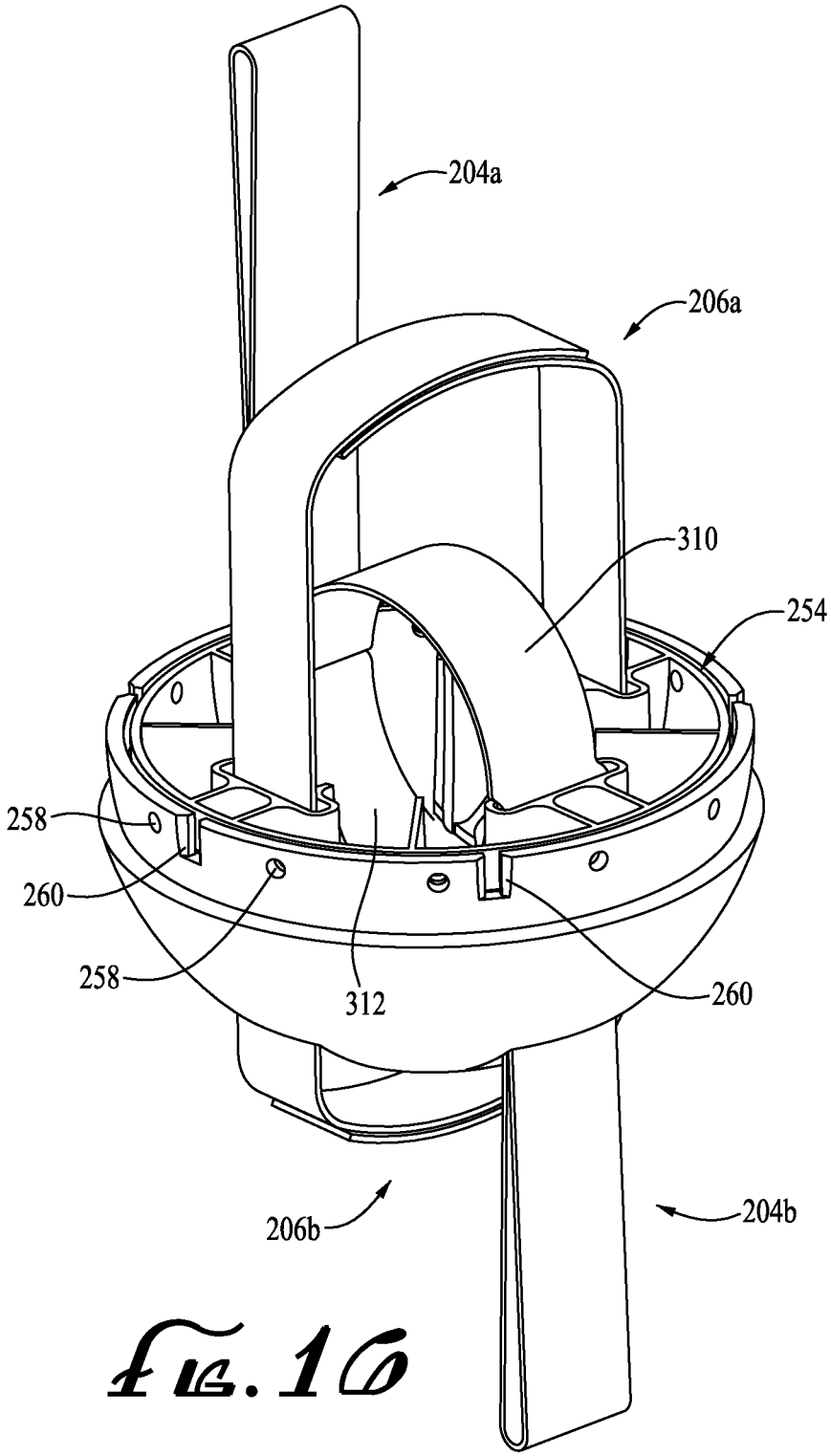
FIG. 16 is a view similar to that of FIG. 15, but with the weight ball removed.
Figure 17:
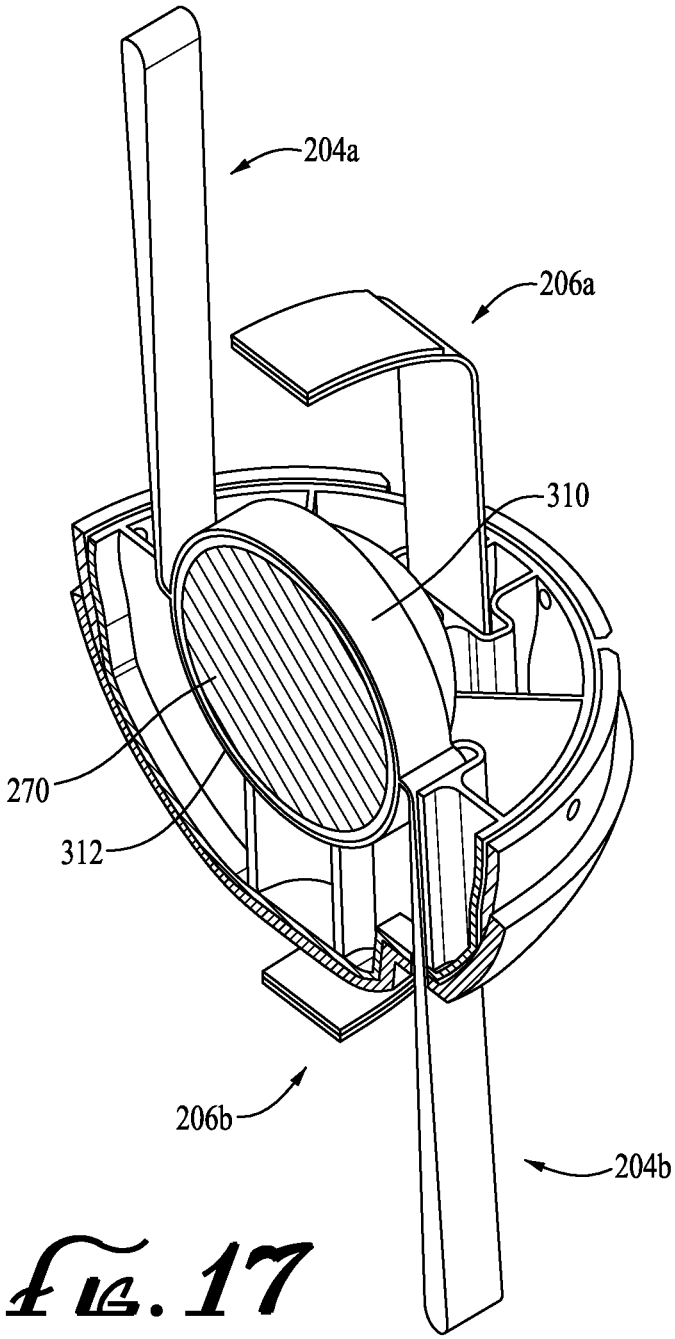
FIG. 17 is a cross-section view along view lines 17-17 of FIG. 10.

Referring now to FIG. 14, there is shown a partially assembled medicine ball device 200, with the upper half shell portion 202*a* removed. FIG. 15 is a view similar to that of FIG. 14, but with the strain loop 280 removed. FIG. 16 is a view similar to that of FIG. 15, but with the weight ball 270 also removed. The outer shell 222*b* comprises a soft plastic or rubber outer shell is located around an outside of the inner shell portion 220*b* and provides a soft and comfortable surface for contact with a user of the medicine ball device. The weight ball 270 is shown with an upper section of the strap 310 of the loop handles 204*a* and 204*b* that passes over a top of the weight ball 270, and with a lower section of the strap 312 (as shown in FIGS. 16, 17, and 19) that passes under the weight ball 270 and ride along the cutout paths 290. When the two half shell portions 202*a* and 202*b* are brought together with the weight ball 270 inside, the sections of straps 310 and 312 will thus be immobilized therein, and prevent the loop handles from able to be pulled out of the medicine ball device. The strain loop 280 with its loops 208 are shown positioned in a circumferential groove 254. The groove 254 is formed as a space between the circumferential rim 244 of the inner shell portion 220 and an upper rim of the outer shell portion 222. The circumferential groove 254 has a predetermined depth and width. The series of spaced apart holes 258 are formed through each outer shell portion 222 in the vicinity of the groove 252, and line up with complementary holes 246 formed in the inner shell portion 220. In addition, a plurality of perpendicular engagement loop slot openings 260 are formed through the outer shell portion 222 thereof and are in communication with the flat end face 240 and the groove 254. The loops 208 of the strain loop 280 pass through the engagement loop slot openings 260. As can be seen, the strain loop 280 is positioned in the groove 254 with its loops 208 extending outwardly. As can be seen, the hand grips 206*a* and 206*b* pass through the hand grip apertures 228 in the hand grip standups 226 and pass straight therethrough, and can slide therethrough to allow the working length of the hand grips to be adjusted. Any force exerted by pulling on one or both hand grips 206*a* and/or 206*b* will not exert a force on the medicine ball device 200 that would tend to try to separate the two half shell portions 202*a* and 202*b*.

Turning back to FIGS. 13 and 14, the two half shell portions 202*a* and 202*b* are retained together by a strain loop 280 in the form of an elongate strap having a desired width, thickness, and length, with spaced apart holes 282 formed therethrough. The width of the strap will preferably be less than twice the depth of the groove 254 formed in the two half shell portions 202*a* and 202*b*. The length of the strap will be sized to allow the strap to be placed in the groove 254 of the two half shell portions 202*a* and 202*b* with the holes 282 in the band 280 aligned with the holes 258 and 246 formed in the outer shell and inner shell, respectively, and with loop sections 208 of the band being looped out through the plurality of perpendicular engagement loop slot 260 openings are formed through the outer shell portion 222. The loops 208 will be sufficient large so that they are available for engagement with D-rings, clips, carabiners, and the like and function as attachment points that are readily accessible by a user. These accessories are preferably attached with detachable clips, for example, such as carabiners, snap clips, and the like, as shown with respect to previously described embodiments of the invention. It is also possible to simply loop the desired accessory through the attachment, such as the case with loops. As an alternative to a strap, a preformed band formed of a desired strong material can be used, including but not limited to a composite band with flexible loop formed therearound. The strap can be formed of known materials, including but not limited to nylon, para-aramid synthetic fiber, natural or artificial fabric, woven metal, metal with flexible attachment points, composite materials, etc.

The loops 208 can be used to retain other rings, clips, carabiners, and the like. In one embodiment, the strain loop can be made of fabric (e.g., nylon, para-aramid synthetic fiber, such as Kevlar®, fiberglass, etc.), composites (e.g., carbon fibers materials), plastic, metal, or other high strength and preferably comprise a ring structure with a plurality of spaced apart integral loops 208 formed therewith. In the case of fabric or composite band the integral loops can be formed by taking a length of strap, forming holes around the strap at predetermined positions, and inserted the strap into a grove formed between inner shell and outer shell with the short sections of folded strap retained together to form each loop by sew lines. One half of the strain loop 280 is retained against the outside of contained in the groove formed at terminal edges of each shell, with the integral loops extending outside of the shells through loop openings. Another possibility is for the strain loop 280 to comprise an elongate section of strap material, and instead of looping sections of the strap material to form loops, instead string separate rings or D-loops on the strap, with the separate rings or D-loops being accessible from outside of the medicine ball device through the engagement loop openings 260 of the outer shell 222 and the loop apertures 212 in the center band 210.

FIG. 17 is a cross-section view along view lines 17-17 of FIG. 14. As can be seen in this figure, the upper section of the strap 310 of the loop handles 204*a* and 204*b* passes over a top of the weight ball 270, and the lower section of the strap 312 passes under the weight ball 270.

Figure 18:
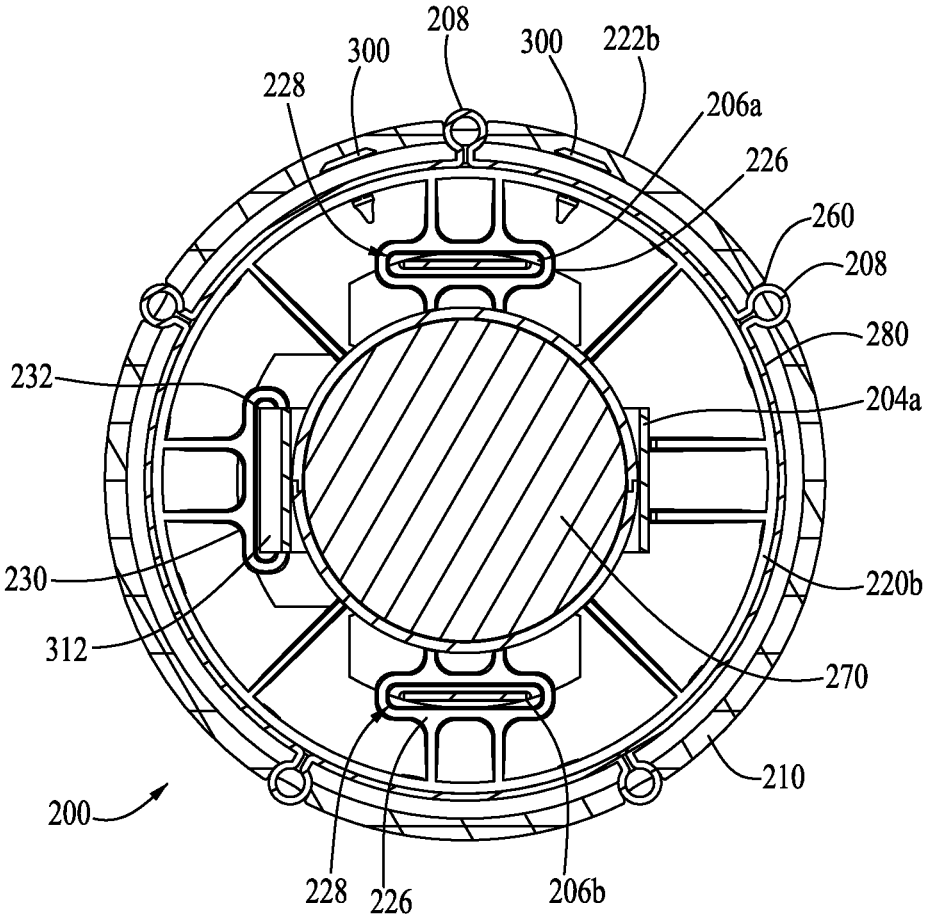
FIG. 18 is a cross-section view along view lines 18-18 of FIG. 10.

FIG. 18 is a cross-section view of the assembled medicine ball device 200 along view lines 18-18 of FIG. 10, FIG. 19 is a cross-section view along view lines 19-19 of FIG. 10, and FIG. 20 is a cross-section view along view lines 20-20 of FIG. 10. Various features shown include the inner shell portion 220*b*, outer shell portion 22*b*, hand grip standups 226 and hand grip apertures 228, elongate loop handle standup 230 and loop handle aperture 232 over which the lower section of loop material 312 passes to pass under the weight ball 270, and the continuation of this one layer of strap that forms part of the loop handle 204*a*. Also shown is the strain loop 280 with loops 208, which loops 208 pass through perpendicular engagement loop slot openings 260 and the center band 210 which covers the fasteners 300 (with just a few being shown.) The relatively free passage of the straps forming the hand grips 204*a* and 204*b* that pass through the medicine ball device can be seen. Likewise, the use of the strain loop 280 to permanently hold together the two half shell portions with the weight ball 270 instead are shown. As shown in FIG. 20, the weight 270 itself can optionally be contained in a weight shell 314, which can be used to help adjust tolerances between the weight ball 270 and the weight cavity 224.

By changing the material of the weight 270, e.g., iron, aluminum, lead, brass, ceramic, and/or the weight's wall thickness, etc., the total weight of the medicine ball device 200 of the invention can thereby be manufactured while using the same sized half shell portions 202*a* and 202*b* and other components. In lieu of changing the material of the weight, a non-spherical weight that still has the same center of gravity as a ball but having a desired lighter weight can be used. Indeed, the weight can be formed in the general shape of a ball having divots, cutouts, or contours that maintain the same center of gravity but will allow a same spacer shell 314 (best shown in FIG. 20) to be used. Furthermore, the weight can have symmetrical lobes, e.g., to maintain a snug fit within the cavity so long as its center of gravity remains in the center of the cavity. Likewise, a smaller metal ball of a certain smaller diameter can be used, and the spacer shell 314 can have the same outer diameter but a smaller inner diameter to make up the extra space between the ball and the cavity. Regardless of the shape of the weight 270 used, for example, if the manufacturer wishes to provide medicine ball devices having a variety of different weights, e.g., 2 kg, 3 kg, 4 kg, and 5 kg, and does not want to manufacture different half shell portions, in such case, the weight of the two half shell portions and other components that make up the medicine ball device can be common among the different medicine ball devices, but the weight of the weight ball 270 can be adjusted as necessary.

In lieu of using a center strain loop, the two half shell portions can include other connection features, such as having a lip section on one half shell portion which engages with a recess in the other half shell portion and interlocks therewith using adhesive, fasteners, sonic welding, and/or other known methods.

During assembly, with the weight placed in one the half shell portions, the second half shell is brought into contact with first half shell portion so that the revealed half of the band not already in the groove of the first half shell portion will slide into the groove formed in the second half shell portion with the holes in the band aligned with complementary holes in the second half shell portion. Once this is accomplished, fasteners 300, such as push in plastic ribbed fin fasteners, rivets, screws, etc., are used to permanently affix the two half shell portions together with the elongate strap. In addition to the frictional force that will hold the fasteners in place, adhesives and glues can also be used to help ensure that the fasteners will not detach. To cover up the fasteners and also optionally provide additional strength and attractive to the medicine ball device, the center band with loop apertures 212 can be placed around the assembled medicine ball device.

Referring back generally to FIGS. 10-20, the pair of adjustable hand grips 206*a* and 206*b* allow for quick and easy adjustment to comfortably fit a wide variety of user's hand sizes and preferences. In addition, a pair of elongate loop handles are likewise provided on opposite sides of the medicine ball, and are provided so that users can pass their hands and wrists, and/or feet therethrough for additional utility, as will be discussed below. Prior to attaching the two half shell portions 202*a* and 202*b* together, these adjustable hand grips and elongate loop handles are installed in the medicine ball device 200. The adjustable hand grips positioned on opposite sides of the medicine ball can comprise a single section of flexible hand grip strapping, such as nylon strap, para-aramid synthetic fiber strap, etc., that passes through pairs of spaced hand grip apertures formed in each half shell portion. These hand grip apertures are generally slot shaped for passage of the hand grip strapping and are all preferably oriented in the same direction on the two half shell portions. The pairs of spaced hand grip apertures 216 are spaced wide enough apart to accommodate a wide variety of user's hands. In an exemplary embodiment, an elongate section of hand grip flexible strapping having a first end and second will be provided. Each end preferably has detachable attachment material, such as hook and loop or hook and hook material, etc., attached thereto. From the outside of the medicine ball device, the first end of the elongate section of hand grip flexible strapping will be pass through an entrance of the first hand grip aperture 216 in the first half shell portion, leaving the second end extending out of the first hand grip aperture 216 in the first half shell portion. At the first end of the strap preferably carries of detachable attachment material. The first end of the strap will pass through the first hand grip aperture 216 in the first half shell portion 202*a*, travel through an aligned first hand grip aperture 216 formed in the second half shell portion 202*b* and exit the medicine ball device through the first hand grip aperture 216 in the second half shell portion 202*b*. The strap will then be looped around on the outside of the medicine ball device and enter the second hand grip aperture 216 formed on the first half shell portion, thereby forming a first hand grip 206*a*. The first end will pass through the second hand grip apertures 216 formed in the second half shell portion 202*b* and the first shell portion and exit from the second hand grip aperture 216 formed in the first half shell portion 202*a*. The detachable attachment material located on the first end of the strap will be available for adjustable attachment to the second of the strap. This feature will allow easy adjustment of the working size of the two hand grips. Indeed, the detachable attachable material can be used to adjust the total length of the strap and thus adjust the tightness and looseness of the adjustable hand grips to the user's preferences. Using a single strap will insure that pulling forcing on one or both of the hand grips will not cause any forces which would tend to exert any forces that would tend to pull apart the two half shell portions. By placing the position of the pairs of spaced hand grip apertures generally normal to the plane of the flat ends of the half shell portions, pulling forces on the straps will not exert a force that would tend to separate the shell portions.

In another embodiment, instead of using a single long strap, two strap sections can be used, with one passing through each of the first hand grip apertures of the first and second half shell portions, an another passing through each of the second hand grip apertures of the first and second half shell portions. These two strap sections will likewise has detachable attachment materials on ends thereof to allow adjustment of the size of the hand grip on each side of the medicine ball device, and will be locked in the medicine ball device to prevent the two straps from pulling through. It is also possible for each half shell portion to have two separate, short hand grip straps that pass from inside the medicine ball device and outside through the hand grip apertures, with workings ends thereof having detachable attachment material to allow each grip to be separate adjusted. Doing do would require a total of four short strap sections, with stationery ends of the each short strap sections being prevented from being pulled through, such as by have folded over and sewn ends that will not pull through the hand grip apertures. Another way to accomplish this would be to provide a single strap with detachable attachment material that loops on the inside of each half shell portion, wherein each single strap can likewise be independently adjusted.

Regarding the pair of elongate loop handles 204*a* and 204*b* provided on opposite sides of the medicine ball device, they can be formed by a single section of strap that passes through the interior of the medicine ball device, and exits from two opposite loop handle apertures 214 formed in the half shell portions 202*a* and 202*b*. In one embodiment, the two opposite loop handle apertures 214 are oriented approximately perpendicular to the hand grip apertures 216, and are likewise slot-shaped. Unlike the hand grips, the elongate loop handles 204*a* and 204*b* may come with set lengths. Alternately, length adjustment devices, since as buckles can be included to allow user to adjust the working length of the elongate loop handles. During assembly of the medicine ball device, a long section of strap can be provided and formed into a loop, e.g., by sewing two free ends of the strap together. The strap will then be folded flat and a first end of the folded over strap will be passed from the exit of loop handle aperture formed in a first half shell portion, pass through the inner entrance of the loop handle aperture, fold over around an inner strand off of the loop handle aperture, wrap around an inner surface of the inner ball cavity, and pass up through the inner entrance of the loop handle aperture formed second half shell portion, and exit the medicine ball device. At the inner strand offs of the loop handle apertures, a relief is preferably formed therein to allow the two layers of folded over loop handle straps to folded over the edge of the inner strand without interfering with the fit of the two half shell portions. The inner surface of the inner ball cavity is preferably contoured to receive a layer of strap that passes therein, and in the cavity area, the two layers of strap are separated and the weight ball is placed therein with the two layers of strap sandwiching the ball therein. This method of construction will ensure that when the weight ball is placed in the cavity, it will snuggly be received and thereby help to immobilize the loop strap to prevent the loop handles from being inadvertently pulled thorough the assembled medicine ball device.

The medicine ball device 200 shown and described herein can be used in the same manner as the other embodiments of medicine ball devices described above, without any limitations. Indeed, although not shown, the medicine ball device 200 is for use accessories selected from the group consisting of hand grips on straps, elongate straps, elastic strips and cords, wrist and ankle straps, and detachably attachable clips Moreover, as shown in FIG. 22, it is also possible to locate the groove 254 completely in an edge of the inner shell portions 202*a* and 202*b* (rather than between the inner shell portions and outer shell portions), and in such case, gaps will need to be located at outer surface of the inner shell portion to allow the loops 208 to pass therethrough.

The drawings thus depict the great versatility of the medicine ball devices of the invention, particularly when used with multiple detachable accessories. Having thus described the exemplary embodiments of the present invention, it should be understood by those skilled in the art that the above disclosures are exemplary only and that various other alternatives, adaptations, and modifications may be made within the scope of the present invention. The presently disclosed embodiment is to be considered in all respects as illustrative and not restrictive. The scope of the invention being indicated by the appended claims rather than the foregoing description, and all changes which come within the meaning and range of equivalency of the claims are, therefore, intended to be embraced therein.

What is claimed is:

1. A medicine ball device, comprising:

a shell portion having an internal cavity formed therein and an outside surface;

a weight located in the internal cavity of the shell portion;

a pair of hand grips extending out of the shell portion from opposite sides thereof; and a plurality of attachments accessible from outside of the shell portion, wherein the shell portion comprises two generally semi-spherical shell portions that are retained together by a strain band, which strain band includes the plurality of attachments, and wherein each semi-spherical shell portion has a flat end, a perimeter wall, internal ribbing, passageways for one of the pair of hand grips, and a groove formed around the perimeter wall that communicates with the flat end of each semi-spherical shell portion, wherein the strain band is positioned in the groove of each semi-spherical shell portion and retained thereto with fasteners, with the plurality of attachments extending exterior of the shell portion, thereby retaining the two semi-spherical shell portions together with the weight inside.

2. The medicine ball device of claim 1, further comprising a pair of elongate loop handles extending out of the shell portion from opposite sides of the shell portion, which elongate loop handles pass through the medicine ball device.

3. The medicine ball device of claim 2, wherein the elongate loop handles comprise a strap that engages with the weight to prevent the elongate loop handles from being pulled out of the medicine ball device.

4. The medicine ball device of claim 1, wherein the strain band comprises a strap and wherein the plurality of attachments comprise looped sections of the strap that extends outside of an outer envelope of the shell portion.

5. The medicine ball device of claim 1, wherein the pair of hand grips comprises a strap that passes through the medicine ball device through the passageways, and wherein the working length of the pair of hand grips is adjustable, and wherein pulling on one or both hand grips does not create a force which would tend to pull apart the two semi-spherical shell portions.

6. The medicine ball device of claim 1, wherein the two semi-spherical shell portions each comprise an inner shell portion and an outer shell portion, the inner and outer shell portion being permanently connected together, wherein the inner shell portions are each formed of a material that is harder than a material forming the outer shell portions.

7. The medicine ball device of claim 1, wherein the weight is generally spherical and is adapted to be snugly received in the internal cavity of the shell portion.

8. The medicine ball device of claim 1, wherein the plurality of attachments are spaced apart on the outside of the medicine ball device.

9. A medicine ball device, comprising:

a shell portion having with an internal cavity formed therein and an outside surface;

a weight located in the internal cavity of the shell portion;

a pair of hand grips extending out of the shell portion from opposite sides thereof;

a pair of elongate loop handles extending out of the shell portion from opposite sides of the shell portion, which elongate loop handles pass through the medicine ball device and comprise a strap that engages with the weight to prevent the elongate loop handles from being pulled out of the medicine ball device; and a plurality of attachments accessible from outside of the shell portion, wherein the shell portion comprises two generally semi-spherical shell portions that are retained together by a strain band, which strain band comprises a strap with a plurality of loops formed therein, the plurality of loops comprising the plurality of attachments accessible from outside of the shell portion.

10. The medicine ball device of claim 9, wherein each semi-spherical shell portion has a flat end, a perimeter wall, internal ribbing, passageways for one of the pair of hand grips, and a groove formed around the perimeter wall that communicates with the flat end of each semi-spherical shell portion, wherein the strain band is positioned in the groove of each semi-spherical shell portion and retained thereto with fasteners, with the plurality of attachments thereof extending exterior of the shell portion, thereby retaining the two semi-spherical shell portions together with the weight inside.

11. The medicine ball device of claim 1, wherein the pair of hand grips comprises a strap that passes through the medicine ball device through the passageways, and wherein the working length of the pair of handgrips is adjustable.

12. The medicine ball device of claim 9, wherein the two semi-spherical shell portions each comprise an inner shell portion and an outer shell portion, the inner and outer shell portion being permanently connected together, wherein the inner shell portions are each formed of a material that is harder than a material forming the outer shell portions.

* * * * *